US009290823B2

(12) United States Patent
Zurecki et al.

(10) Patent No.: US 9,290,823 B2
(45) Date of Patent: Mar. 22, 2016

(54) METHOD OF METAL PROCESSING USING CRYOGENIC COOLING

(75) Inventors: Zbigniew Zurecki, Macungie, PA (US); Ranajit Ghosh, Macungie, PA (US); Lisa Ann Mercando, Pennsburg, PA (US); Xiaoyi He, Orefield, PA (US); John Lewis Green, Palmerton, PA (US); David Scott Nelson, Easton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 13/029,289

(22) Filed: Feb. 17, 2011

(65) Prior Publication Data

US 2012/0055592 A1 Mar. 8, 2012

Related U.S. Application Data

(60) Provisional application No. 61/307,253, filed on Feb. 23, 2010.

(51) Int. Cl.
*C21D 6/04* (2006.01)
*C21D 1/667* (2006.01)
(Continued)

(52) U.S. Cl.
CPC *C21D 1/667* (2013.01); *C21D 1/76* (2013.01); *C21D 9/0056* (2013.01); *C21D 9/0062* (2013.01); *F27B 9/12* (2013.01); *F27B 9/20* (2013.01); *F27B 9/24* (2013.01);
(Continued)

(58) Field of Classification Search
CPC ..... C21D 1/667; C21D 1/76; C21D 9/0056; C21D 9/0062
USPC ..... 148/578, 660
See application file for complete search history.

(56) References Cited

U.S. PATENT DOCUMENTS 5,302,213 A 4/1994 Bonner et al.
5,836,166 A * 11/1998 Wardle ..... 62/63
(Continued)

FOREIGN PATENT DOCUMENTS

CN 1158641 A 9/1997
DE 10 10 483 B 6/1957
(Continued)

OTHER PUBLICATIONS

G. Fillari, et al, Effect of Cooling Rates During Sinter-Hardening, presented at PM2TEC 2003, Las Vegas, NV.
(Continued)

*Primary Examiner* — Rebecca Lee
(74) *Attorney, Agent, or Firm* — Rosaleen P. Morris-Oskanian; Amy Carr-Trexler

(57) ABSTRACT

Described herein are a method, an apparatus, and a system for metal processing that improves one or more properties of a sintered metal part by controlling the process conditions of the cooling zone of a continuous furnace using one or more cryogenic fluids. In one aspect, there is provided a method comprising: providing a furnace wherein the metal part is passed therethough on a conveyor belt and comprises a hot zone and a cooling zone wherein the cooling zone has a first temperature; and introducing a cryogenic fluid into the cooling zone where the cryogenic fluid reduces the temperature of the cooling zone to a second temperature, wherein at least a portion of the cryogenic fluid provides a vapor within the cooling zone and cools the metal parts passing therethrough at an accelerated cooling rate.

13 Claims, 13 Drawing Sheets

(51) Int. Cl.

| | |
|---|---|
| ***C21D 1/76*** | (2006.01) |
| ***C21D 9/00*** | (2006.01) |
| ***F27B 9/12*** | (2006.01) |
| ***F27B 9/20*** | (2006.01) |
| ***F27B 9/24*** | (2006.01) |
| ***F27D 9/00*** | (2006.01) |
| *C21D 6/00* | (2006.01) |

(52) U.S. Cl.

CPC ..... *F27D 9/00* (2013.01); *F27D 2009/0081* (2013.01); *F27D 2009/0086* (2013.01)

(56) References Cited

U.S. PATENT DOCUMENTS

| | | | | |
|---|---|---|---|---|
| 6,228,187 | B1 | 5/2001 | Till | |
| 6,338,747 | B1 | 1/2002 | Kosco | |
| 6,508,976 | B2 | 1/2003 | Till | |
| 6,533,996 | B2 | 3/2003 | Serafini, Jr. | |
| 6,725,683 | B1 * | 4/2004 | Laskaris | 62/259.2 |
| 6,783,568 | B1 * | 8/2004 | Bowskill et al. | 75/246 |
| 7,018,584 | B2 | 3/2006 | Serafini, Jr. | |
| 7,497,984 | B2 | 3/2009 | Atrom | |
| 7,536,873 | B2 | 5/2009 | Nohlen | |
| 2003/0049717 | A1 * | 3/2003 | Vesey et al. | 435/39 |
| 2003/0131912 | A1 | 7/2003 | Rancon et al. | |
| 2005/0220994 | A1 * | 10/2005 | Mehta et al. | 427/180 |
| 2006/0086529 | A1 * | 4/2006 | Corsaro et al. | 174/125.1 |
| 2007/0125463 | A1 * | 6/2007 | Kohasko et al. | 148/630 |
| 2008/0087204 | A1 | 4/2008 | Stanescu et al. | |

FOREIGN PATENT DOCUMENTS

| | | | |
|---|---|---|---|
| EP | 0 312 161 | A1 | 4/1989 |
| EP | 0 779 370 | A1 | 6/1997 |
| JP | 62224628 | A2 | 10/1987 |
| WO | 01/07674 | A1 | 2/2001 |
| WO | 02/072904 | A1 | 9/2002 |

OTHER PUBLICATIONS

M.L. Marucci, et al, A review of current sinter-hardening technology, presented at PM2004 World Congress, Vienna, Austria.

Sintering a path to cost-effective hardened parts, Technical Trends, MPR Jun. 2005.

P.K. Sokolowksi and B.A. Lindsley, Influence of Chemical Composition and Austenitizing Temperature on Hardenability of PM Steels, PowderMet 2009, 2009 Int. Conf. on Powder Metallurgy & Particulate Materials, Jun. 28-Jul. 1, 2009, Las Vegas, NV.

M.C. Baran, et al, Application of Sinter-Hardenable Materials for Advanced Automotive Applications such as Gears, Cams and Sprockets, presented at SAE 2000 World Congress, Detroit, MI.

Boehm, G.; "Reducing the Cost of Bright Annealing by the Cryogen Rapid Cooling Process"; Fachberichte Huettenpraxis Metallweiterverarbeitung; 1985; vol. 23 No. 12; pp. 1078-1080.

* cited by examiner

Sintering Furnace, Prior Art

Sintering Furnace with Convective Cooling System, Prior Art

Sintering Furnace containing cryogenic fluid inlet with direct spray onto parts

METHOD OF METAL PROCESSING USING CRYOGENIC COOLING

CROSS-REFERENCE TO RELATED APPLICATIONS

This application claims the benefit of U.S. Provisional Application No. 61/307,253, filed 23 Feb. 2010.

BACKGROUND OF THE INVENTION

Described herein are a method, a system, and an apparatus for sintering metal components or metal alloy components, particularly steel components. More particularly, described herein are a method, a system, and an apparatus for sintering steel components.

Powder metallurgy is routinely used to produce a variety of simple- and complex-geometry carbon steel components requiring close dimensional tolerances, good strength and wear resistant properties. This process, also known as sinter hardening, typically is used to produce iron-based alloys which exhibit high hardness through consolidating and sintering metallurgical powders. The process involves pressing metal powders that have been premixed with organic lubricants into useful shapes and then sintering them at high temperatures in continuous furnaces into finished products in the presence of controlled atmospheres. The controlled atmosphere for this process typically contains nitrogen and hydrogen or an endo gas mixture.

The continuous sintering furnaces normally contain three distinct zones, i.e., a preheat zone, a hot zone, and a cooling zone. The preheat zone is used to preheat components to a predetermined temperature and to thermally assist in removing organic lubricants from components. The hot zone is used to sinter components. The temperature of the hot zone typically ranges from 600° C. to 1350° C. However, this temperature may vary depending upon the metal powders being processed. The cooling zone is used to cool components prior to discharging them from continuous furnaces. In the cooling zone, transformation to the martensite phase may occur.

Sintering of metals including sinter hardening of steels under inert and reducing atmospheres are well known and established. A comprehensive review of technological factors controlling sinter-hardening may be found in "Effect of Cooling Rates During Sinter-Hardening" by G. Fillari et al., presented at PM2TEC 2003, Las Vegas, Nev., "A review of current sinter-hardening technology" by M. L. Marucci et al., presented at PM2004 World Congress, Vienna, Austria, "Sintering a path to cost-effective hardened parts" published in Technical Trends, *MPR* June 2005, 0026-0657/05© 2005 Elsevier Ltd., and in the 2009 publication titled: "Influence of Chemical Composition and Austenitizing Temperature on Hardenability of PM Steels" by P. K. Sokolowski and B. A. Lindsley, *PowderMet* 2009, 2009 Int. Conf. on Powder Metallurgy & Particulate Materials, June 28-July 1, Las Vegas, Nev.

The cooling temperature and rate is important in controlling the final properties of the end product such as surface hardness, hardness, tensile strength, and/or sintered density. One method of improving one or more of these properties is to add one or more alloying materials to the metal powder composition to control its phase transformation. For example, for certain sinter hardenable materials, delaying the austenite to ferrite plus carbide transition to form martensite may increase the hardenability. As hardenability increases, martensite may form at progressively lower cooler rates. Examples of suitable alloying materials include, but are not limited to, manganese (Mn), chromium (Cr), molybdenum (Mo), copper (Cu), nickel (Ni), and combinations thereof. Higher levels of alloying additions increases the costs associated with raw materials of the parts. Moreover, higher levels of alloying additions in powder metallurgy parts may reduce powder compressibility which, in turn, affects the capital and operating costs of operations.

Other methods of overcoming the problem of low cooling rates in the continuous, sintering and sinter hardening furnaces, in addition to, or as an alternative of elevated levels of alloying additions in the parts processed, include using pure hydrogen or $H_2$-rich furnace atmospheres to accelerate heat transfer. However, the use of the $H_2$ atmospheres increases operating as well as capital costs due to the $H_2$ cost and safety risks involved in handling explosive gases. Low cooling capacity of the conventional, convective cooling systems used in the industrial practice today creates, additionally, a bottleneck in the production process because fewer parts can be run through continuous furnace at once, or lower processing speeds need to be used, in order to cope with the task of affecting heat removal in the cooling zone.

Thus, one of the key challenges in sinter-hardening and other heat treating operations is to provide sufficient part cooling rates in the cooling zone to produce a martensitic phase transformation and obtain the desired hardening effect. The conventional, convective gas-cooling systems installed in the continuous sintering furnaces are significantly less efficient than the conventional oil, polymer, salt, or water quenching baths and high-pressure gas quenching systems that are preferred in batch-type heat treating operations. The use of quenching baths in the continuous furnace operations would, nevertheless, be impractical, and the use of high-pressure gas quenching cells extremely limited.

There is a need in the art to improve the cooling profile in a sinter hardening process without necessitating the addition of one or more expensive alloying materials, or alternatively, reducing the amount of alloying materials added.

BRIEF SUMMARY OF THE INVENTION

Described herein are a method, an apparatus, and a system for metal processing that improves one or more properties of a sintered metal part such as, but not limited to, hardness, sintered density, tensile strength, and/or surface hardness by controlling the process conditions of the cooling zone of a continuous furnace using one or more cryogenic fluids. The method, apparatus and system described herein satisfies one or more of the needs in the art by introducing into the cooling zone a cryogenic fluid containing at least one liquid phase wherein at least a portion of the cryogenic fluid evaporates within the cooling zone in order to enhance and accelerate the cooling of the metal part. In certain embodiments, an inert cryogenic fluid, a reducing cryogenic fluid, or combination thereof such as liquefied nitrogen (LIN), liquid helium, hydrogen, and argon can be used as the cryogenic fluid.

In one aspect, there is provided a method for processing a metal part in a furnace comprising: providing the furnace wherein the metal part is passed therethough on a conveyor belt and comprises a hot zone and a cooling zone wherein the cooling zone has a first temperature; and introducing a cryogenic fluid into the cooling zone where the cryogenic fluid reduces the temperature of the cooling zone to a second temperature, wherein at least a portion of the cryogenic fluid provides a vapor within the cooling zone and cools the metal parts passing therethrough. In one embodiment, the method further comprises directing at least a portion of the vapor toward the exit end of the furnace. In another embodiment, the method further comprises venting at least a portion of the vapor before entering the hot zone.

In one aspect, the cryogenic fluid is sprayed directly onto the metal parts within the cooling zone of the furnace. In another aspect, the cryogenic fluid is injected into the cooling zone via a convective cooling system and indirectly contacts the metal parts within the cooling zone of the furnace. In a further aspect, the cryogenic fluid contacts the metal parts directly within the cooling zone of the furnace and indirectly via a convective cooling system.

In another aspect there is provided a method for processing a metal part comprising: providing the furnace wherein the metal part is passed therethough on a conveyor belt and comprises a hot zone and a cooling zone wherein the cooling zone has a first temperature; introducing a cryogenic fluid into the cooling zone where the cryogenic fluid reduces the temperature of the cooling zone to a second temperature, wherein at least a portion of the cryogenic fluid provides a vapor within the cooling zone and cools the metal parts passing therethrough; and treating the metal parts to one or more temperatures below 0° C.

DETAILED DESCRIPTION OF THE INVENTION

Figure 1A:
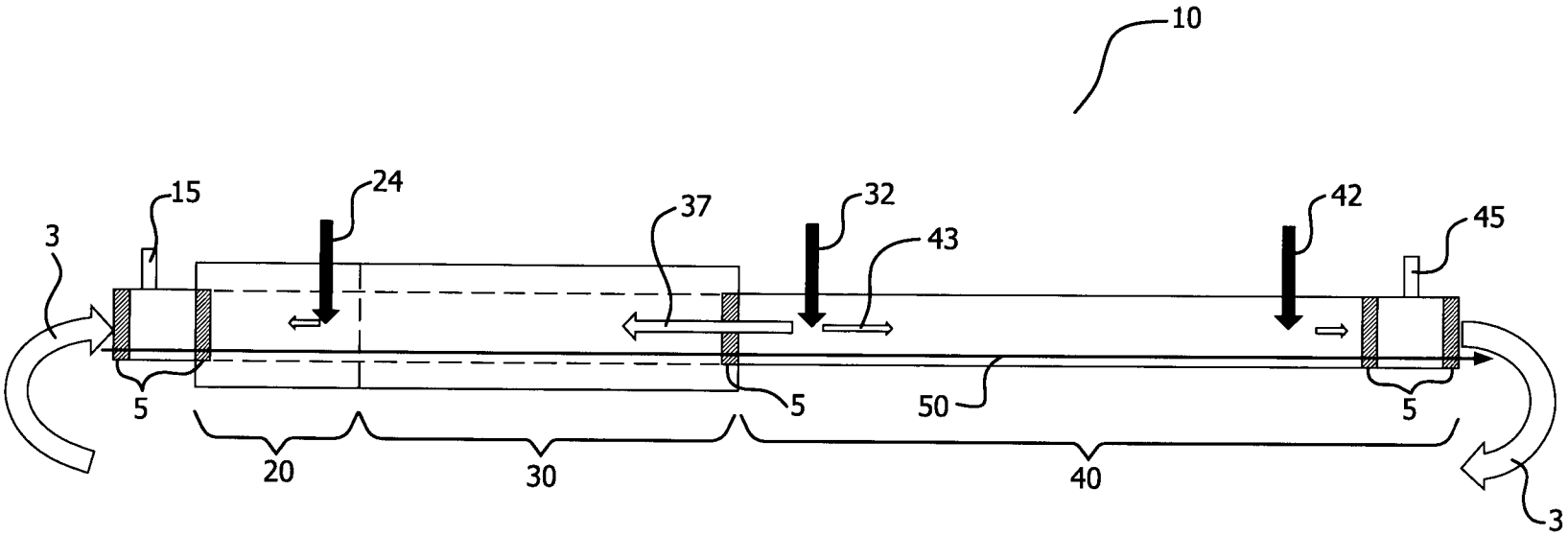
FIG. 1*a* provides an illustration of a typical continuous furnace of the prior art that is used for sinter hardening of metal parts.

Described herein is a method, an apparatus, and a system for cooling metal or metal alloy parts comprising an injection of one or more cryogenic fluids. A processed metal part that has been subjected to high temperature processing or treatment is exposed to an atmosphere comprising one or more cryogenic fluids. The cooling rate is accelerated with the injection of one or more cryogenic fluids in the cooling zone such that one or more desirable material properties of the metal part such as, but not limited to, hardness, tensile strength, sintered density, and/or surface hardness can be obtained. In certain embodiments, the cryogenic fluid—once it is injected into the cooling zone of a continuous furnace—boils, evaporates to form a vapor and provides refrigeration. In this embodiment, the excess vapor from the cryogenic fluid or fluids can be vented by additional means or, alternatively, directed toward the exit end of the furnace in order to prevent cooling of the hot zone. In certain embodiments of the method, system or apparatus described herein, the cryogenic fluid can be sprayed directly onto the metal parts, indirectly injected into the convective cooling system, or a combination thereof. Not being bound by theory, it is believed that the cryogenic fluid enhances cooling within the temperature range of the part by the combined effect of the latent enthalpy of liquid evaporation and the heat of cryogenic vapor. It is believed that the use of enhanced or accelerated cooling may allow for the processing of sinter hardenable powder metallurgy parts containing reduced levels of alloying additions which are commonly used to increase steel hardenability. In this regard, the material properties of the metal part can be the same or improved using less alloying additions. In addition, enhanced or accelerated cooling may allow for at least one of the following advantages: a shorter cooling zone within the furnace, a higher loading of metal parts upon the conveyor belt within the furnace, and/or higher throughput in continuous furnaces. Further, the method, apparatus, and system described herein may also allow for sinter hardening of larger sized parts or work pieces which presently may not be sinter-hardened because of cooling limitations.

The system, method and/or apparatus described herein may be used, for example, in the sinter hardening of typical powder-based metallurgical parts as well as heat treating of tool steels, austenitic, ferritic, and martensitic stainless steels and various copper alloys. In embodiments wherein carbon is present in the metal powder composition, it may be in the form of graphite, in alloyed form and other suitable form. Other elements such as boron (B), aluminum (Al), silicon (Si), phosphorous (P), sulfur (S), or combinations thereof can also be added the metal powders to obtain the desired properties in the final sintered product. In addition to the foregoing, still further elements that can be added to the metal parts include, but are not limited to, manganese, chromium, molybdenum, copper, nickel, and combinations thereof. An exemplary metal powder composition that can be used to produce parts by sintering according to the method described herein can be iron (Fe), iron-carbon (C) which may comprise up to 1% carbon, Fe—Cu—C with up to 25% copper and 1% carbon, Fe—Mo—Mn—Cu—Ni—C with up to 1.5% Mo, and Mn, each, and up to 4% each of Ni and Cu. For embodiments wherein the metal powder is used to provide a tool or stainless steel part, the composition of the metal powders may comprise 10.5% for Mo, 12.5% for W, 12% for Co, 18% for Cr, and 8% for Ni. In certain embodiments, the metal powder composition can include a lubricant to, for example, facilitate compaction during the pressing step. Examples of such lubricants include, for example, zinc stearate, stearic acid, ethylene bis-stearmide wax or any other lubricant to assist in pressing components from them. The metal powders are pressed into a compact part under high pressure and then placed within a continuous furnace.

An example of a prior art continuous furnace that may be used with the method, apparatus or system described herein is provided in FIG. 1. The furnace depicted in FIG. 1 may be similar to those continuous belt sintering furnaces provided by Abbott Furnace Company of St. Mary's Pa. It is understood, however, that other furnace configurations may be used with the method, apparatus, and/or system described herein. Referring to FIG. 1, furnace 10 has a delubrication or pre-heat zone 20, a sintering or hot zone 30, and a cooling zone 40, with a conveyor belt 50 for transporting work pieces to different parts of the furnace 10. Arrows 3 show the direction of travel for conveyor belt 50. The conveyor belt 50 may be made from a variety of metallic and/or ceramic materials, e.g., superalloys or stainless steels, silicon carbides, and oxide ceramic compounds that are capable of withstanding the furnace environment. Conveyor belt 50 may be typically operated at speeds typically ranging from about 1 to about 12 inches per minute (in./min.). In certain furnaces, a second pre-heat zone (not shown) may also be provided in furnace 10 between pre-heat zone 20 and hot zone 30. The cooling zone 40 can be defined as the region after the hot zone 30 within which cooling of the metal parts takes place. It is understood that one or more coolers may be provided in the cooling zone 40. The furnace 10 is typically operated at atmospheric pressure, with venting flues (not shown) provided at one or both ends of the furnace 10 for exhausting process gases. In the embodiment depicted herein, barriers or curtains 5 may by placed to control or isolate certain zones with regard to temperature, gas flow, atmospheric composition or other attributes within various portions of furnace 10. Curtains 5 are independently connected to an actuator or other device (not shown) to open, close, or partially open or partially closed depending upon the desired process cycle.

Incoming work pieces such as powder metal compacts or metal parts first enter pre-heat zone 20 for pre-sintering treatment. The pre-heat zone 20 is typically maintained at an elevated temperature, e.g., up to about 1200° F. (650° C.). The gaseous atmosphere in the pre-heat zone 20 usually comprises a relatively high dew point gas mixture, which may be generated by the combustion of a fuel, e.g., methane ($CH_4$), in an external burner (not shown). Other gases such as hydrogen, argon, helium, or $N_2$, among others, may also be present in pre-heat zone 20. Combustion products such as CO, carbon dioxide ($CO_2$), $N_2$, and water ($H_2O$), along with any residual gases such as $CH_4$ and oxygen ($O_2$), air, and/or other gases may be injected into pre-heat zone 20 via an optional gas inlet 24 or other means. In embodiments having an optional gas inlet 24, gas inlet 24 may be also used to inject an oxidizing gas stream such as, but not limited to, air and/or $O_2$ that may promote dissociation of lubricant into $CO_2$, $O_2$, and/or other dissociation products from the lubricants contained within the green part. FIG. 1*a* also shows an optional pilot flame 15 that may be used to burn off carbonaceous components contained within the work piece such as binders or waxes. The temperature in the pre-heat zone 20 should be sufficiently high such that lubricants in powder metal parts may be vaporized prior to entering hot zone 30.

After pre-sintering treatment, work pieces or metal parts are transported from the first pre-heat zone 20 to the second pre-heat zone (if present), and subsequently to hot zone 30 for sintering. In general, sintering conditions such as temperature or gas composition may vary according to the specific materials contained within the work pieces or metal parts and the desired applications. For sintering of powder metal parts, hot zone 30 may generally be maintained within a temperature ranging from about 900° C. to 1600° C. or from about 1100° C. to about 1300° C. In certain embodiments, the sintering gas or sintering atmosphere within hot zone 30 may contain a feed gas mixture of nitrogen ($N_2$) and hydrogen ($H_2$), with a $H_2$ concentration in the mixture being typically less than about 12%. In certain embodiments, the sintering gas or sintering atmosphere of hot zone 30 comprises from about 0.1% to about 25% by volume nitrogen or from about 75% to about 99% by volume nitrogen. In this or other embodiments, the atmosphere of hot zone 30 comprises hydrogen in an amount varying from about 1% to 12%, or from about 2% to about 5%, or from about 1% to about 100% by volume. The $N_2$ and $H_2$ feed gas may be pre-mixed at room temperature and supplied to hot zone 30 via gas inlet 32. In one embodiment, the hydrogen gas used in nitrogen-hydrogen atmosphere can be supplied to hot zone 30 in gaseous form in compressed gas cylinders or vaporizing liquefied hydrogen. In an alternative embodiment, it can be supplied to hot zone 30 by producing it on-site using an ammonia dissociator. In this embodiment, the sintering atmosphere containing $N_2$ and $H_2$ may be supplied to the hot zone 30 by using dissociated ammonia, which provides a feed gas mixture of about 25% $N_2$ and about 75% $H_2$ by volume from dissociation of anhydrous ammonia in a catalytic reactor (not shown). Depending on the specific sintering application, the $N_2$ and $H_2$ mixture from dissociated ammonia is further diluted with additional $N_2$ or inert gases prior to being introduced into the furnace 10. In one particular embodiment, the nitrogen gas used in nitrogen-hydrogen atmosphere comprises less than 10 parts per million (ppm) residual oxygen content. In this embodiment, it can be supplied to hot zone 30 by producing it using a cryogenic distillation technique. In an alternative embodiment, it can be supplied to hot zone 30 by purifying non-cryogenically generated nitrogen.

In yet another embodiment, the sintering gas or hot zone or sintering atmosphere may also be provided by an endo gas, comprising about 20% CO, 40% $H_2$, and the balance $N_2$, from an endo gas generator (not shown).

The gas inlet 32 in commercial furnaces is usually located in a transition zone between the hot zone 30 and the cooling zone 40, e.g., which can be an exposed tube portion that is also called a muffle (not shown). Alternatively, or in addition, an additional gas inlet (not shown) may be provided at a location within the hot zone 30 for introducing the sintering feed gas. In the continuous furnace depicted in FIG. 1*a*, cooling zone 40 contains a gas inlet 42 to flow inert gas that minimizes entrance of air from exit side of furnace and may also dilute atmosphere coming out of the furnace so that the concentration of the flammable gas is below flammability limit (e.g., for $H_2$ approximately 3-5% by volume). Cooling zone 40 may also contain an optional pilot flame 45 to maintain a stable combustion front and prevent propagation of flame further into the furnace which minimizes flaring. Sintering gases introduced at gas inlet 32 will flow upstream towards the hot zone 30 (as shown by arrow 37), as well as downstream towards the cooling zone 40 (as shown by arrow 43). In one particular embodiment, the direction of the gas flow upon injection wherein approximately 80% of the $N_2/H_2$ injected flows into the hot zone (as shown by arrow 37) and approximately 20% of the $N_2/H_2$ injected goes into the cooling zone (as shown by arrow 37) provided that the optional curtains 5 are open. In certain embodiments, the $N_2$ and $H_2$ feed gas is preferably one with a relatively low dew point, or ranging from about −30° F. to about −80° F., in order to avoid undesirable effects arising from the presence of moisture. For example, in certain embodiments such as those embodiments wherein the work pieces or metal parts comprise iron and/or other moisture-sensitive components, the presence of moisture may hinder the sintering of these parts by lowering the ability of the sintering atmosphere to remove oxygen from iron oxide or the oxide of alloying component, which may be required for effective sintering iron-containing and/or other moisture-sensitive components metals.

After exiting hot zone 30, cooling of the metal parts may proceed in different stages or at different cooling rates, which may vary with the configuration or design of the furnace 10. For example, in a transition region such as the muffle, the temperature of the metal parts is still relatively high and radiant cooling may be the key mechanism of cooling. As the temperature of the metal parts continues to decrease, a convective cooling system (such as that shown in FIG. 1*b*) or a water jacket cooling sections (not shown in FIG. 1*a*) may become dominant. For embodiments involving sintering of metal parts containing iron, carbon, and alloying additions, microstructure phase changes becomes important at temperatures of less than about 800° C. For these or other embodiments, the cooling rate of the metal part or work piece at temperatures from about 800° C. to about 100° C. may be of particular interest, and it is known that improved properties of powder metal parts can be achieved by increasing the cooling rate in this temperature range. However, other temperature regimes may be important depending upon the composition of the metal parts being processed.

Figure 1B:
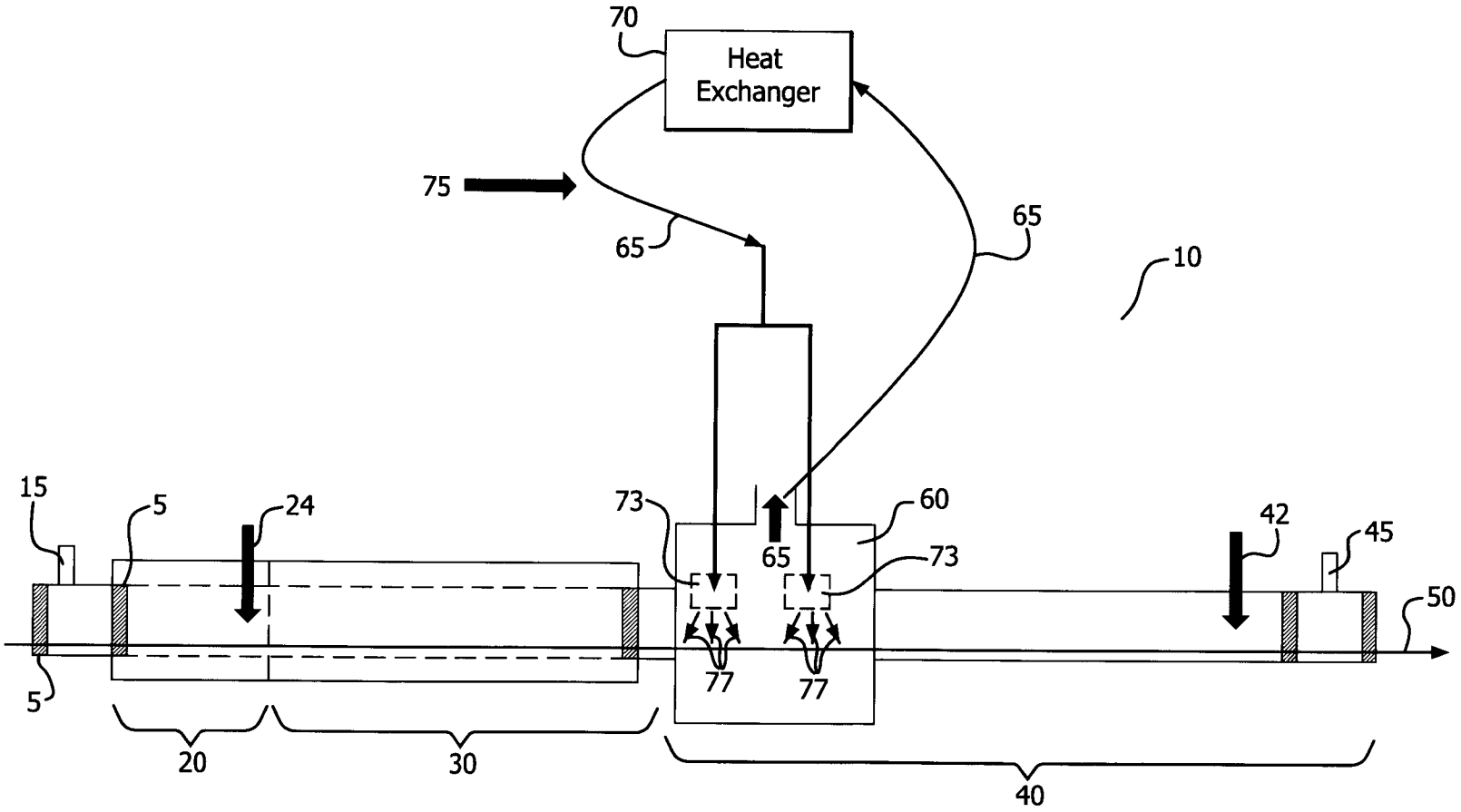
FIG. 1*b* provides an illustration of a typical continuous furnace of the prior art that is used for sinter hardening of metal parts that further comprises a convective cooling system.

As previously mentioned, a portion of the cooling zone 40 may correspond to regions defined by one or more coolers, including water coolers and convection coolers. An example of a convection cooler suitable for practicing embodiments of the invention is a VariCool Convective Cooling System provided by Abbott Furnace Company of St. Mary, Pa. This type of arrangement is depicted in FIG. 1*b*. Varicool convective cooling system 60 is placed between the hot zone 30 and cooling zone 40 and uses convective gas circulation to provide a certain cooling profile. Arrows 65 depicts the fluid communication or gas flow between plenum boxes 73 contained within cooling system 60, heat exchanger 70, and input 75 for make-up feed gas. Cooling gas is sprayed indirectly into the furnace atmosphere through one or more plenum boxes 73 which circulate within the furnace atmosphere as shown by arrows 77 and indirectly contact the work piece or sintered part (not shown) as it travels therethrough on conveyor belt 50. In such a recirculating-type of cooler, gases are drawn from the cooling zone 40 by a blower in cooling system 60 (not shown). These gases are passed through heat exchanger 70 and re-introduced back to the cooling zone 40 for cooling the sintered parts. Coolers of other designs may also be used. One or more gas inlets 75 may also be provided to cooling system 60 for introducing a make-up gas from an external source (not shown) to the cooling zone 40. Typically, the composition of make-up gas is the same as the composition of the sintering gas or sintering gas atmosphere such as, but not limited to, nitrogen or nitrogen and hydrogen mixtures.

Figure 2A:
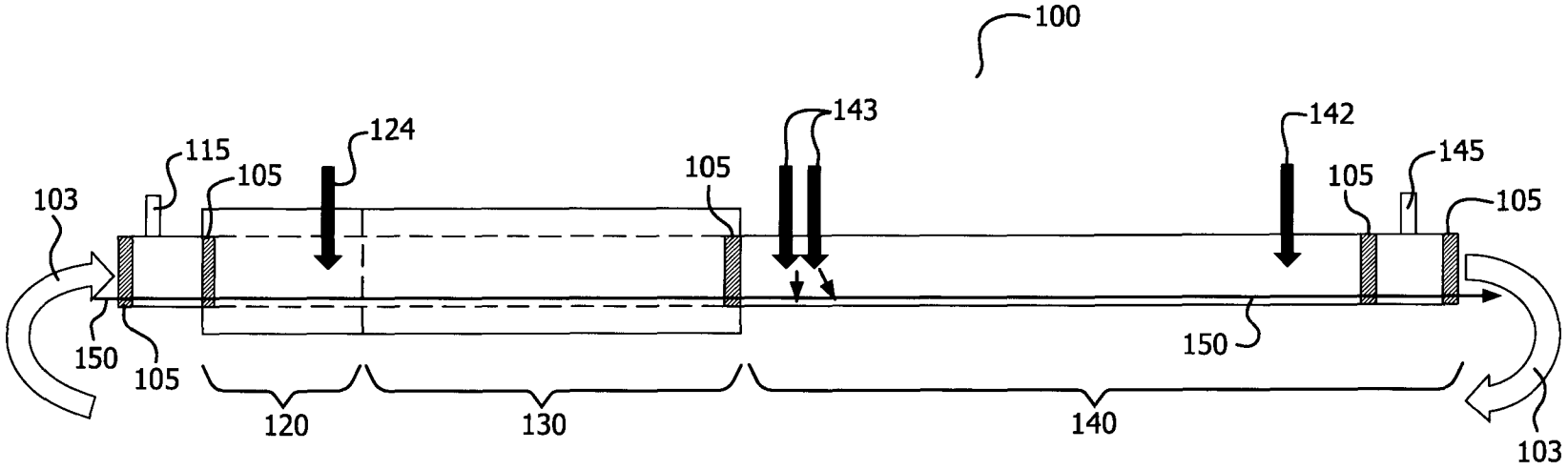
FIG. 2*a* provides an illustration of an embodiment of the method and apparatus described herein wherein the cryogenic fluid is sprayed directly onto a work piece or metal part using a sprayer or manifold comprising one or more nozzles.

FIGS. 2*a* through 2*h* depict various embodiments of the method, apparatus and system described herein wherein one or more cryogenic fluids is added to enhance the cooling of a workpiece or metal part. FIG. 2*a* shows furnace 100 having one or more inlets 143 that allow a flow of a conventional sintering gas and/or one or more cryogenic fluids into the furnace atmosphere. In the embodiment depicted in FIG. 2*a*, the cryogenic fluid is sprayed directly onto the parts as the parts are passed through the transition area between hot zone 130 and cooling zone 140 of furnace 100 on conveyor belt 150. Furnace 100 comprises conveyor belt 150 to carry one or more work pieces or metal parts through furnace 100 in the direction shown by arrows 103. Furnace 100 comprises a delubrication or pre-heat zone 120, a sintering or hot zone 130, and a cooling zone 140. Conveyor belt 150 may be made from a variety of metallic and/or ceramic materials, e.g., superalloys or stainless steels, silicon carbides, and oxide ceramic compounds that are capable of withstanding the furnace environment, and may be operated at typical speeds ranging broadly between about 1 and about 12 inches per minute (in./min.). In certain embodiments, a second pre-heat zone (not shown) may also be provided between pre-heat zone 120 and hot zone 130. It is understood that one or more coolers may be provided in the cooling zone 140. Furnace 100 is typically operated at atmospheric pressure, with venting flues (not shown) provided at one or both ends of the furnace 100 for exhausting process gases. In the embodiment depicted herein, one or more curtains 105 may provided between different zones in furnace 100 to control or isolate certain zones with regard to temperature, gas flow, atmospheric composition or other attributes. In certain embodiments, furnace 100 may further comprise an optional gas inlet 142 to flow an inert gas to minimize entrance of air from exit side of furnace; the inert gas may also dilute atmosphere coming out of the furnace so that the concentration of the flammable gas is below flammability limit (e.g., for $H_2$ approximately 3-5% by volume). Like in FIGS. 1*a* and 1*b*, cooling zone 140 may also contain an optional pilot flame 145 to maintain a stable combustion front and prevent propagation of flame further into the furnace which minimizes flaring. Curtains 105 are each independently connected to an actuator or other device (not shown) to open, close, or partially open or partially close depending upon the desired process cycle.

The gaseous atmosphere in the pre-heat zone 120 usually comprises a relatively high dew point gas mixture, which may be generated by the combustion of a fuel, e.g., methane ($CH_4$), in an external burner. Combustion products such as CO, carbon dioxide ($CO_2$), $N_2$ and water ($H_2O$), along with any residual gases such as $CH_4$ and oxygen ($O_2$) may be injected into pre-heat zone 120 via an optional gas inlet 124. Other gases such as hydrogen, argon, helium, or $N_2$, among others, may also be present. Gas inlet 124 may be used to inject a mildly oxidizing gas such as, but not limited to, $O_2$, air, and/or other gases that promote dissociation of lubricant into $CO_2$, $O_2$, or other dissociation products from the lubricants contained within the green part. FIG. 2*a* also shows optional pilot flame 115 that may be used to burn off carbonaceous components such as binders or waxes contained within the work piece. The temperature in the pre-heat zone 120 should be sufficiently high such that lubricants in powder metal parts may be vaporized prior to sintering.

After passing through the pre-heat zone, work pieces or metal parts (not shown) are transported on conveyor belt 150 to an optional second pre-heat zone (not shown), and subsequently to the hot zone 130 for sintering. In general, sintering conditions such as temperature or gas composition may vary according to the specific materials and applications. For sintering of powder metal parts, hot zone 130 may generally be maintained within a temperature ranging from about 900° C. to 1600° C. or from about 1100° C. and about 1300° C. In certain embodiments, the sintering or hot zone atmosphere may contain a feed gas mixture of nitrogen ($N_2$) and hydrogen ($H_2$), with a $H_2$ concentration in the mixture being typically less than about 12%. In certain embodiments, the sintering or hot zone atmosphere comprises from about 0.1% to about 25% by volume nitrogen or from about 75% to about 99% by volume nitrogen. In this or other embodiments, the hot zone atmosphere comprises hydrogen in an amount varying from about 1% to 12% or from about 2% to about 5% by volume or from about 1% to about 100%. In certain embodiment, the $N_2$ and $H_2$ feed or sintering gas may be supplied to the hot zone 130 via one of gas inlets 143 which enters the furnace as shown by the arrows.

In the embodiment shown in FIG. 2*a*, gas inlets 143 are generally located in the cooling zone 140. However, other locations for gas inlets 143 may be selected depending upon the desired heating and cooling profile. Sintering gases introduced at gas inlet 143 may flow upstream towards the hot zone 130, as well as downstream in the cooling zone 140, provided that the optional curtains 105 are open.

Cryogenic fluid is also introduced into furnace 100 through one or more inlets 143. Inlets 143 may be optionally terminated with a jet nozzle (not shown) to inject gas and fluid in various points of furnace 100. The conventional feed gas and cryogenic gas can be introduced into cooling zone 140 separately such as by separate gas inlets, introduced together as a mixture in one gas inlet or sprayer, or alternately pulsed until the desired processing condition is met (e.g., temperature profile, atmospheric composition, etc). In one particular embodiment, inlet 143 can be a single sprayer, spray bar, or manifold that comprises a plurality of nozzles that are located in various locations across the width of belt that inject the conventional gas and the at least one cryogenic fluid. An example of such a sprayer or manifold is shown in FIG. 2*h*. In one particular embodiment of the method described herein, the atmosphere in cooling zone 140 comprises nitrogen, hydrogen, and one or more cryogenic fluids such as liquefied nitrogen boiling at −195° C. at 1 atmosphere pressure.

Figure 2B:
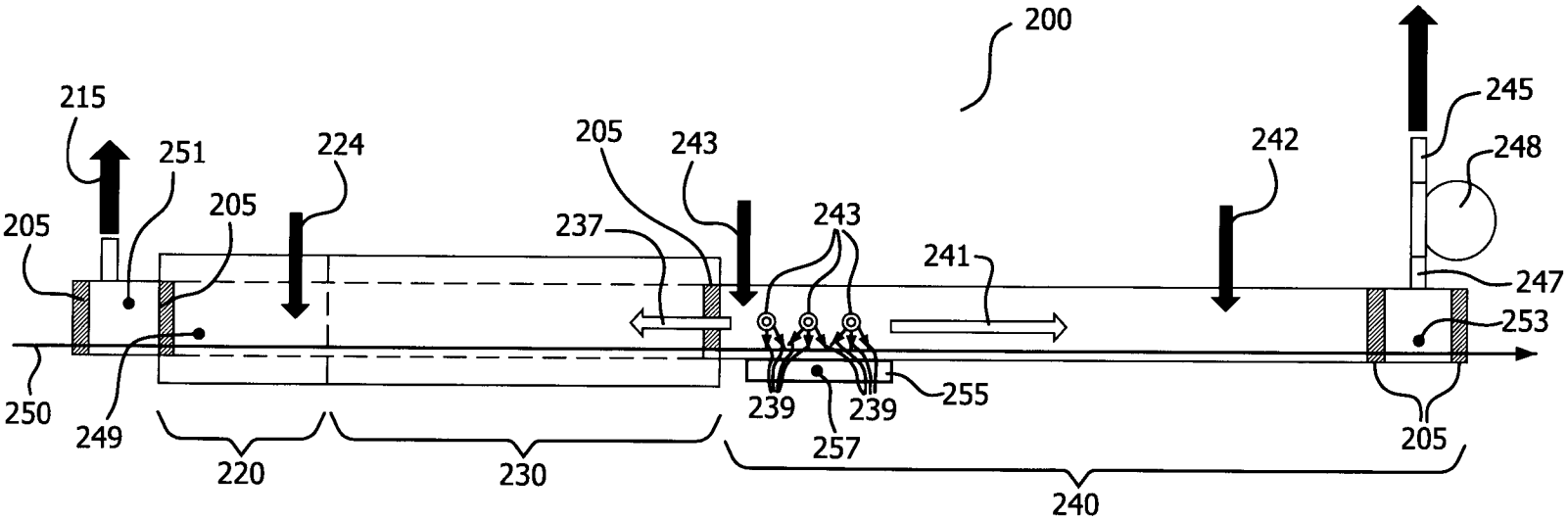
FIG. 2*b* provides an illustration of an alternative embodiment of the method and apparatus described herein wherein the cryogenic fluid is sprayed directly onto a work piece or metal part wherein the at least one cryogenic fluid enters into the cooling zone using one or more cryogenic spraying bars comprising a plurality of nozzles that are in fluid communication with a cryogenic fluid source and wherein the nozzles are used to control the length of the cooling region and/or span the width of the furnace.

FIG. 2*b* provides an example of another embodiment of the method, apparatus and system described herein wherein cryogenic fluid is sprayed directly upon the metal parts passing through furnace 200 on conveyor belt 250 through one or more inlets 243. Conventional feed or sintering gas may also be introduced through one or more inlets 243. In one particular embodiment, cryogenic fluid and/or conventional feed gas is introduced into cooling zone 240 using the spray bar or sprayer depicted in FIGS. 2*f* and 2*h*. Furnace 200 comprises a delubrication or pre-heat zone 220, a sintering or hot zone 230, and a cooling zone 240. In the embodiment shown in FIG. 2*b*, furnace 220 further comprises an optional inlet 224 to introduce a mildly oxidizing gas such as, but not limited to, $O_2$, air, and/or other gases that promotes dissociation of lubricant into $CO_2$, $O_2$, or other dissociation products from the lubricants contained within the green part. Furnace 200 has a plurality of optional furnace curtains 205 in the locations shown which can act to isolate certain portions of the furnace. In the embodiment shown in FIG. 2*b*, cryogenic fluid is introduced into furnace 200 through one or more inlets 243 wherein conventional feed gas and cryogenic gas can be introduced into the cooling zone separately, introduced together as a mixture, or pulsed until the desired processing condition is met (e.g., temperature profile, atmospheric composition etc). In one particular embodiment, inlets 243 may be terminated with nozzles 239 wherein at least a portion of the cryogenic fluid and the conventional gas mixture and the evaporation products thereof is directed to the exit point of furnace 200 in the direction shown by arrow 241. In certain embodiments, the pressure of the cryogenic fluid may range from 15 to 500 psig. In this or other embodiments, nozzles 239 can also be directed to the entry point of cooling zone 240 in the direction shown by arrow 237 to control or shorten the cooling zone.

In the embodiment shown in FIG. 2*b*, the gases introduced through the inlet 243 and the optional inlet 224 and 242 are directed out through the stack or duct at the opening of furnace 200 at optional pilot flame 215 and optional pilot flame 245 near the exit of furnace 200.

In one particular embodiment, it is believed that the optimum flow of gases between the opening and exit of furnace 200 or gas flows 237 and 241 are such that the excess nitrogen gas or vapor produced by vaporization of the cryogenic fluid or liquid nitrogen injected in cooling zone 240 is directed primarily towards the exit of furnace 200. In this embodiment, the reason for this "uneven" partition may be to maximize the cooling effect in cooling zone 240 while minimizing an undesired chilling of hot zone 230. In certain embodiments, a blower 248 such as an electric withdraw blower may be used to accomplish this by pulling the gas from cooling zone 240 into a venting duct 247 that is optionally equipped with pilot flame 245 which ignites any flammable gases present in the sintering atmosphere. It is desired that the operation of blower 248 provide the proper balance within the furnace atmosphere by not withdrawing too much gas which could entrain ambient air from the opening and exit of furnace 200, while withdrawing sufficient volumes to remove the excess nitrogen vapors in order to prevent their transfer out via hot zone 240. With regard to the later, the "too high"

withdraw condition to hot zone 240 could lead to the risk of flammable gas explosion inside the furnace and/or detrimental oxidation of the furnace, processed parts and conveying belt. By contrast, the "too low" withdraw condition may lead to a sub-optimum cooling of the parts being processed and excessive loading of the heaters located in hot zone 240. To remedy this, sensor monitors 249 and 253 that measure the amount in terms of volume percentage of $H_2$ and $O_2$ in the gas atmosphere of the furnace may be installed in the front and back of furnace 200. For example, if the hydrogen and/or oxygen readings in those areas start to differ from the normal levels needed for safe processing or approach alarm levels, the monitor 249 and/or 253 may send a feedback signal to the motor of blower 248 to limit its output or turn it off. Monitors 249 and 253 are in electric communication with the motor of blower 248 using a programmable logic controller (PLC) device, computer, or other means (not shown). In this or other embodiments, the PLC may be used to automate this feedback loop control. This "upset flow situation" may occur if the cryogenic fluid flow into cooling zone 240 suddenly drops below a pre-set level or is cut. Typical alarm levels, for example, are approximately 1 vol % for oxygen and 3 vol % for hydrogen. An optional thermocouple 251 or an array of staged thermocouples can be installed at the opening of furnace 200 near the gas exit and/or optional pilot flame 215. Changes in the gas flow rate will be registered by the thermocouple as a departure from certain, normal temperature condition and may also trigger changes in the output of blower 248 output the way described above for the "upset flow situation". The embodiment depicted in FIG. 2*b* provides a method of venting the furnace atmosphere if one or more components of the atmosphere are flammable. However, it is envisioned that depending upon the atmosphere of the furnace there may or may not be a need to vent. For example, if the atmosphere of the furnace is non-flammable, one can redirect the flow of furnace atmosphere by simply opening one or more of the curtains 205.

In the embodiment shown in FIG. 2*b*, furnace 200 further comprises a water jacket 255. This embodiment may be suitable for those embodiments wherein furnace 200 comprises an austenitic stainless steel or superalloy wire mesh belts as the material for conveyor belt 250. If the wire mesh of conveyor belt 250 is not dense enough, the liquid nitrogen sprays, expanding from the sprayers 243, could penetrate the belt and start quenching the furnace floor below. The furnace floor is typically made of mild steel which means that a prolonged exposure to the cryogenic jets may embrittle it and lead to the risk of thermal cracks. Many counter-measures can be used to eliminate this risk: using an austenitic stainless steel floor instead of carbon steel, placing protective sheets between the parts and the belt, using dense-woven wire mesh belts, and/or using water jacket 255 around a portion of the floor of furnace 200. In typical usages, water jackets are built around at least a portion of the cooling zone of the furnace to assist in part cooling via radiation and gas-phase convection. The temperature of the water flowing in the jacket may range from about 15° C. to about 35° C. In the embodiment shown in FIG. 2*b*, this temperature range may also be sufficient to prevent freezing and embrittlement of the floor of furnace 200. In this or other embodiments, water jacket 255 further comprises a thermocouple 257 which is used to monitor the temperature of the water. If the water temperature drops outside of the desired range or drops to a temperature of around 0° C. or below, the flow of cryogenic fluid through 243 into cooling zone 240 should be reduced and or cut. Further, in certain embodiments, the water in water jacket 255 may be reheated to minimize the risk of steel embrittlement during the cryogenic cooling of the metal parts within cooling zone 240.

Figure 2C:
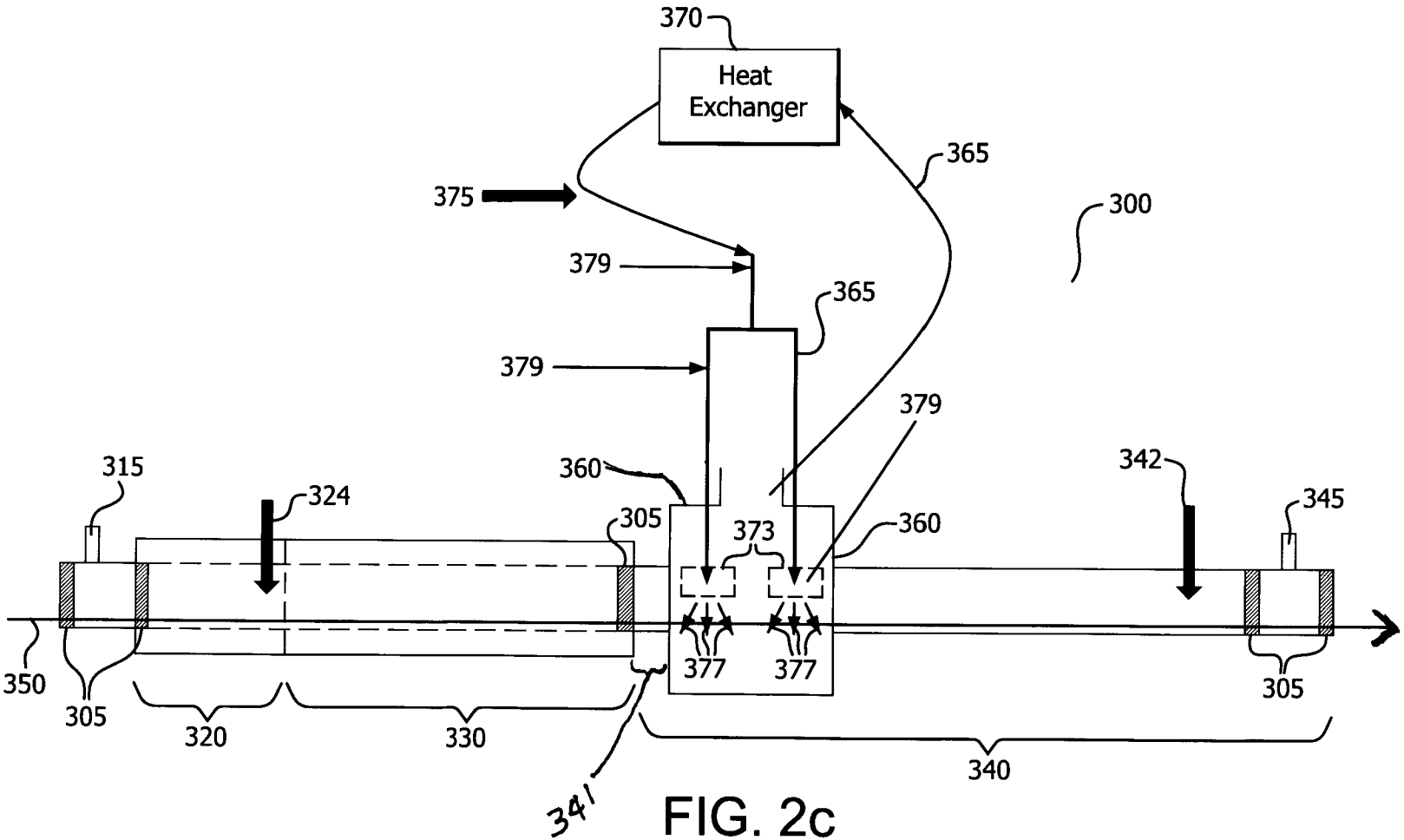
FIG. 2*c* provides an illustration of an alternative embodiment of the method and apparatus described herein wherein the cryogenic fluid is sprayed indirectly onto a work piece using a convective cooling system wherein the at least one cryogenic fluid enters into the cooling zone using one or more plenum boxes.

FIG. 2*c* provides an example of an embodiment of the method and apparatus described herein wherein the convective cooling system such as the Varicool system is in fluid communication with the cooling zone wherein the cryogenic fluid is injected into the conventional stream of gas that is circulated within the Varicool system. It can be used to inject into one or more of the plenum boxes or into the system itself prior to introduction into cooling zone. In one embodiment, the gas stream may enter from water heat exchanger into a T-shaped connection into the Varicool system—the at least one cryogenic fluid can be introduced into the return gas, the main gas entry line, or combinations thereof. Make up gas is also shown being injected into the furnace shown.

Referring again to FIG. 2*c*, furnace 300 comprises a preheat zone 320, a hot zone 330, and a cooling zone 340. Furnace 300 further comprises a conveyor belt 350 to convey one or more work pieces or metal parts (not shown) therethrough. Furnace 300 also comprises a plurality of furnace curtains 305, optional pilot flames 315 and 345 proximal to the opening and exit of furnace 300, an optional inlet 324 to introduce an oxidizing or other gas into pre-heat zone 320, and an optional inlet 342 to introduce an inert gas into the cooling zone. A convective cooling system 360 such as the Varicool system is placed between the hot zone 330 and cooling zone 340 and uses convective gas circulation to provide a certain cooling profile. Transition zone 341 shows the portion of the furnace between hot zone 330 and convective cooling system 360 within cooling zone 340. Arrows 365 depicts the fluid communication or gas flow between plenum boxes 373 contained within cooling system 360 and heat exchanger 370. As FIG. 2*c* illustrates, one or more cryogenic fluids are introduced into the fluid circulation shown by arrows 365 at 379 and a conventional feed or sintering gas at 375 is sprayed indirectly into the furnace atmosphere through one or more plenum boxes 373 which circulate within the furnace atmosphere as shown by arrows 377 and indirectly contact the workpiece or sintered part (not shown) as it travels therethrough on conveyor belt 350. In such a recirculating-type of cooler, gases are drawn from the cooling zone 340 by a blower in cooling system 360 (not shown). These gases are passed through heat exchanger 370 and re-introduced back to the cooling zone 340 as shown by arrows 365 for cooling the sintered parts. Coolers of other designs may also be used. One or more gas inlets 375 may also be provided to cooling system 360 for introducing a make-up gas from an external source (not shown) to the cooling zone 340. Typically, the composition of make-up gas is the same as the composition of the sintering gas atmosphere, such as but not limited to nitrogen or nitrogen and hydrogen blends.

Figure 2D:
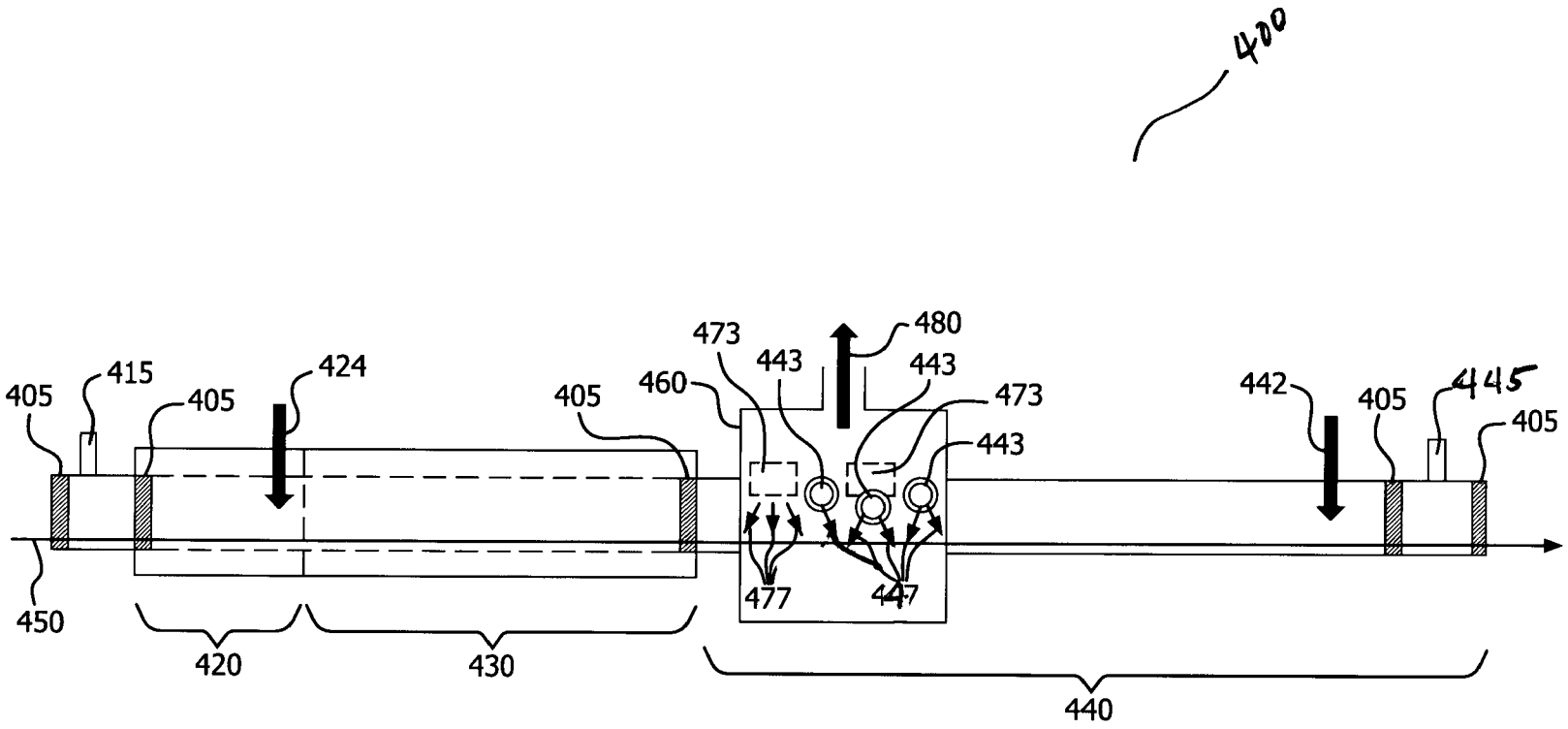
FIG. 2*d* provides an illustration of yet another embodiment of the method and apparatus described herein wherein the cryogenic fluid is sprayed directly onto a work piece and indirectly through a cooling system wherein the at least one cryogenic fluid enters into the cooling zone through one or more plenum boxes.

FIG. 2*d* provides an example of a furnace 400 having a convective cooling system 460 wherein the introduction of a cryogenic fluid takes place outside the circulation of gas within the convective cooling system. Furnace 400 comprises a pre-heat zone 420, a hot zone 430, and a cooling zone 440. Furnace 400 further comprises a conveyor belt 450 to convey one or more work pieces or metal parts (not shown) therethrough. Furnace 400 also comprises a plurality of furnace curtains 405, optional pilot flames 415 and 445 proximal to the opening and exit of furnace 400, an optional inlet 424 to introduce an oxidizing gas into pre-heat zone 420, and an optional inlet 442 to introduce an inert gas into the cooling zone. A convective cooling system 460 such as a Varicool system is placed between the hot zone 430 and cooling zone 440 and uses convective gas circulation to provide a certain cooling profile of the metal part. In some embodiments, the cryogenic fluid is directly sprayed upon work pieces or metal parts using inlets 443. In one particular embodiment, cryogenic fluid and/or conventional feed gas is introduced into cooling zone 440 using the spray bar or sprayer depicted in FIG. 2*g* or 2*h*. In certain embodiments, nozzles 447 on inlets 443 can be independently directed towards the entry of cooling zone 440, the exit of the cooling zone 440 or facing each other depending upon the desired gas flow pattern and cooling effect desired. In this or other embodiments, the cryogenic fluid and/or sintering gas can be introduced into one or more of the plenum boxes 473 which can contact the parts indirectly as shown by arrows 477. Return gas comprised of a sintering gas or feed gas and cool gas or vapor evolved from the at least one cryogenic fluid injection, is directed out of convective cooling system 460 through an outlet shown by arrow 480.

In the method, system and apparatus described herein in FIGS. 2*a* through 2*h*, a gas comprising one or more cryogenic fluids from an external gas source, such as but not limited to, liquid nitrogen (LIN), argon, or other fluids is introduced or injected to the cooling zone via one or more gas inlets within cooling zone. The cryogenic fluid may be introduced into the cooling zone either directly via an inlet connected to the external source such as, for example, the embodiments depicted in FIGS. 2*a* and 2*b*, or indirectly through the cooling zone via a convective cooling system such as, for example, the embodiment shown in FIG. 2*c*, or combinations thereof, such as, for example, the embodiment shown in FIG. 2*d*. It is also possible that the one or more cryogenic fluids is introduced to the cooling zone via an inlet located downstream of the cooling zone, as long as there is sufficient gas flow towards the cooling zone such that an appropriate cooling atmosphere be established in the cooling zone. Alternatively, the externally supplied cooling gas may also contain $N_2$ or other inert gases such as argon (Ar), helium (He), among others, in addition to $H_2$ or $NH_3$ or other reducing and/or carburizing gases such as a series of light-weight hydrocarbons: $CH_4$, $C_2H_2$, $C_2H_4$, $C_3H_6$, $C_3H_8$, etc. The concentration necessary to affect certain improved properties may depend on the specific compositions of the processed work pieces or metal parts, or with the configurations of the furnace.

As previously mentioned, the cryogenic fluid, once it is injected into cooling zone boils, evaporates to provide a vapor, and causes cooling. In certain embodiments, the excess vapor from the cryogenic fluid or fluids can be vented by additional means or, alternatively, directed toward the exit end of furnace in order to prevent cooling of the hot zone. Depending on the exact configuration and the relative gas flows in the hot zone and the cooling zone, it is also possible that some of the excess vapor of the introduced cryogenic fluids to the cooling zone be transported upstream to the hot zone. In embodiments wherein the cryogenic fluid comprises $N_2$ or LIN this may give rise to a sintering atmosphere having a $N_2$ concentration that is higher than that found in the original sintering gas or feed gas mixture. In certain embodiments, it may be preferable that the excess vapor from the one or more cryogenic fluids introduced for cooling rate control be confined generally to the cooling zone. This may be achieved, for example, by modifying the furnace to inhibit gas flows from the cooling zone to the hot zone, or vice versa. In certain embodiments, a physical barrier such as a curtain made of ceramic, metal or insulating fiber, or a gas curtain formed by an inert gas flow which redirects the flow of gas from the hot zone to the cooling zone may be provided. This could be combined with either eliminating the conventional curtains installed on the exit side of the furnace or minimizing the gas pressure drop across those curtains, e.g. making them more porous to the gas stream. In one particular embodiment, gas flows within the furnace may be arranged to provide a positive flow from the hot zone to the cooling zone, e.g., by the use of an auxiliary fan. In another embodiment, the excess vapor may be removed from cooling zone by the use of one or more vents. In another embodiment, sintered metal parts in the cooling zone are exposed to a gaseous atmosphere having one or more cryogenic fluids during operation. Thus, it is possible to optimize the cooling process in order to achieve desired material properties in the processed parts. For embodiments wherein powder steel parts are sintered, it is desirable that the cooling rate be controlled, e.g., accelerated, within a temperature range of from about 900° C. to about −100° C., or from about 800° C. to about 100° C., or from about 750° C. to about 200° C.

In certain embodiments, the temperature range of cooling may fall below 0° C. which is referred to herein as sub-zero treatment. For example, certain metal parts such as steels, even if the cooling rate within these temperature ranges is high enough to produce the desired austenite-to-martensite transformation rather than the undesired austenite-to-bainite or austenite-to-pearlite and ferrite transformations, a certain amount of so-called retained austenite may be unavoidable due to internal, compressive stresses generated by martensite formation. Retained austenite, however, can be further converted into martensite if the metal part is cooled to one or more temperatures below the water freezing point. In these embodiments, sub-zero treatment may involve the use of dry ice (solid carbon dioxide) refrigerators, mechanical compression refrigerators, and/or cooling in liquefied, cryogenic nitrogen or its vapors. In this or other embodiments, sub-zero treatment can be carried-out in one or more insulated batch containers as an additional processing step. Depending on the steel parts processed and their composition, it is believed that the benefits of sub-zero treatments may include one or more of the following: elimination of soft (retained austenite) spots on quenched and tempered steels, more uniform and/or deeper hardened layer, improved wear resistance, minimized tendency for surface cracks, and/or enhanced dimensional stability over the lifetime of service life.

Figure 2E:
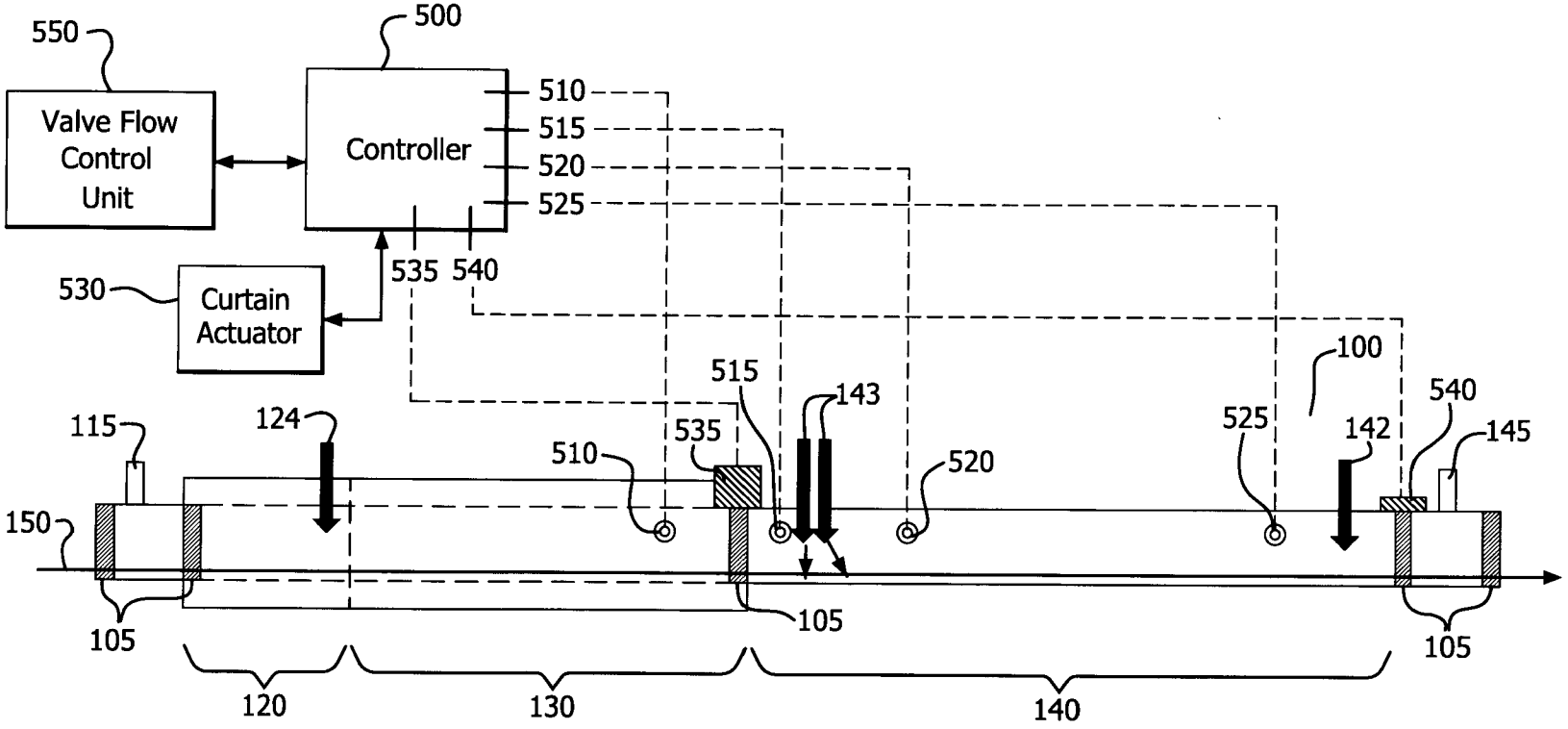
FIG. 2*e* provides an illustration of an alternative embodiment of the method and apparatus described in FIG. 2*a* wherein the cryogenic fluid is sprayed directly onto a work piece and wherein the apparatus further comprises a controller in electrical communication with a plurality sensors located in various locations within the furnace to provide real-time feed back of the temperature profile within the furnace. In certain embodiments, the controller is also in electrical communication with actuators that may open, close or partially open and close the curtains in one or more locations of the furnace. In this or other embodiments, the controller is in further electrical communication with a valve flow control unit that can control the flow of gases or fluids that are introduced into and/or contained within the furnace via valves.
Figure 2F:
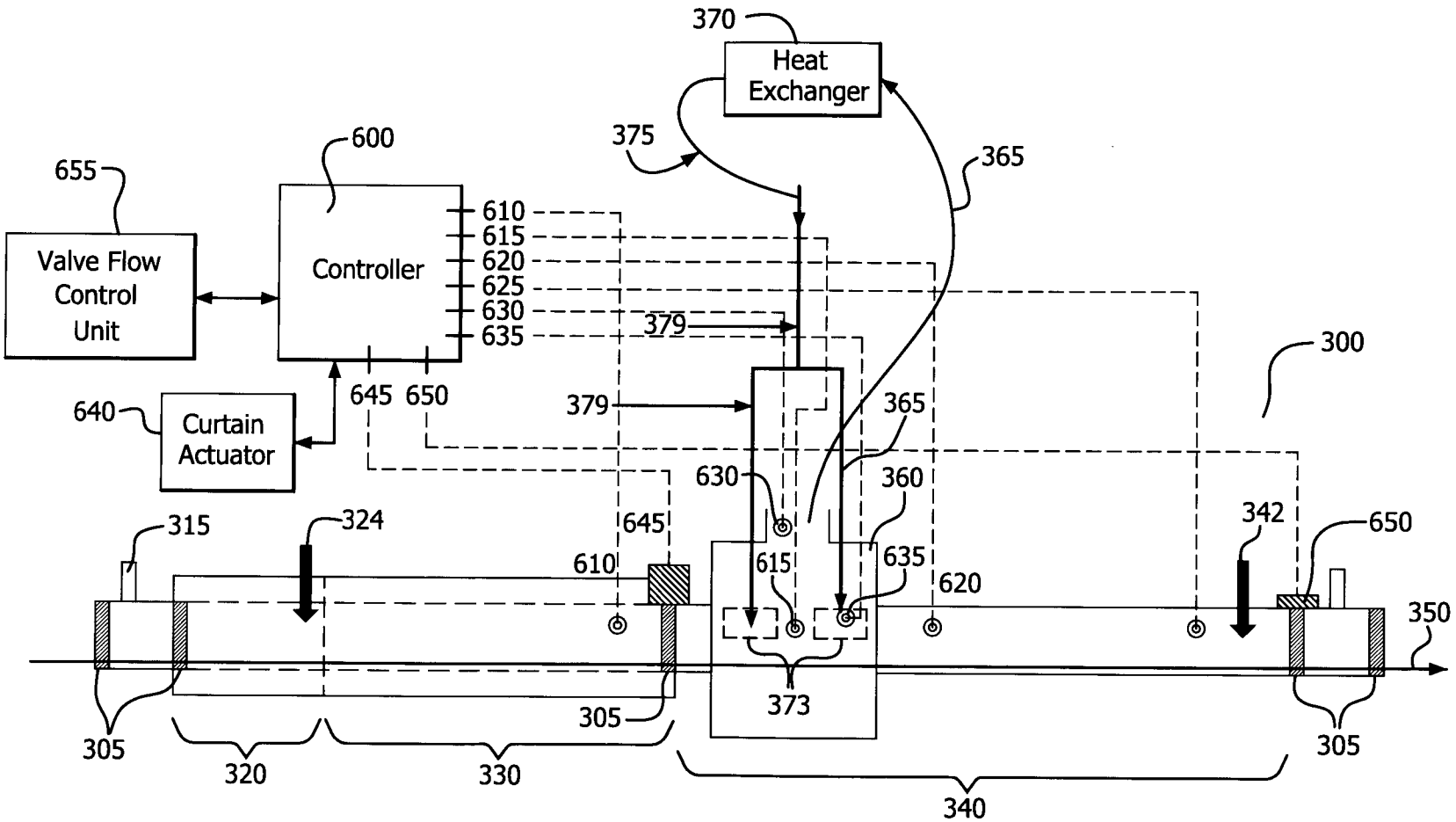
FIG. 2*f* provides an illustration of an alternative embodiment of the method and apparatus described in FIG. 2*c* wherein the cryogenic fluid is sprayed indirectly upon a work piece using a convective cooling system wherein the cryogenic fluid enters into the cooling zone using a plurality of nozzles and wherein the apparatus further comprises a controller in electrical communication with a plurality of sensors located in the hot zone and cooling zone to provide real-time feed back of the temperature profile within the furnace. In certain embodiments, the controller is also in electrical communication with actuators that may open, close or partially open and close the curtains in one or more locations of the furnace. In this or other embodiments, the controller is in further electrical communication with a valve flow control unit that can control the flow of gases or fluids that are introduced into or contained within the furnace via valves.

Controlling temperatures of parts during cooling process may be important in certain embodiments because various conveyer loads and speeds may be used in the industrial operations, and various metal alloys with diverse geometric configurations may be loaded, each demanding a different cooling rate. Several methods can be used to control the method described herein. FIGS. 2*e* and 2*f* provides examples of embodiments of the method, system and apparatus described herein in FIGS. 2*a* and 2*c*, respectively, wherein the metal parts or work pieces are controlled during the cooling process using real-time information. In these embodiments, one or more sensors are located in different zones throughout the furnace and based upon the information obtained from the sensors (e.g., temperature, pressure, atmospheric composition, etc.), it can, for example, direct one or more actuators to open or close a curtain in various locations throughout furnace. The embodiments depicted in FIGS. 2*e* and 2*g* employ a sensor or a plurality of sensors can be placed in various portions of the hot zone and/or the cooling zone above the parts traveling on conveyer to monitor the furnace atmosphere temperatures. The one or more sensors can be thermocouples, infrared, fiber optic, or a combination thereof that are in communication with the valve flow control units to the cryogenic fluid inlet to determine when or if to inject the one or more cryogenic fluids into various parts of the furnace to control its temperature. The furnace atmosphere temperatures show a substantial degree of correlation to the temperature of the parts. A series of calibration curves can be developed for correlating evolving temperatures of the parts to those measured by thermocouples in the gas phase above. In one embodiment of this approach, infra-red (IR), non-contact thermometers can be used to look down at the parts or at the furnace walls above within the cooling zones and, thus, report direct temperature measurements. The IR sensor lenses can be located inside the cooling zones or optical fibers can be used to make the actual IR-light energy measurement outside the furnace such as, for example, the embodiment shown if FIG. 2*e*. Additional approaches to the control of cooling may be used if the cryogenic fluid is injected into a pre-existing, convective gas cooling system such as, for example, the embodiment shown if FIG. 2*f*. Thus, one or more control thermocouples may be installed in the duct which carries the return gas from the cooling zone to water heat exchanger. The principle of process control is the same as that depicted in FIG. 2*e*. Moreover, thermocouples can be installed inside the gas plenum boxes jetting cold gas down at the parts traveling through the cooling zone. This way of feedback loop allows for the measurement of a combined effect of the cryogenic cooling and the water heat exchanger cooling. Yet another, external way of sensing the cooling effects is available and involves measurement of the temperature of gas exiting the furnace along with the parts processed. These can be combined with the temperature measurements of the cooling water exiting the heat exchanger and/or the cooling jackets conventionally installed on the walls of furnace muffle in the cooling zones. In the embodiments described herein, the sensors can provide an output to a processor, PLC, computer or other device which, in turn, modifies the opening of the valve(s) controlling the flow rate of the cryogenic fluid, sinter gas, and/or other gases within the furnace atmosphere.

As previously mentioned, FIG. 2*e* is similar to the embodiment shown in FIG. 2*a* but further comprises an optional controller 500 which is in electrical communication with thermocouples, sensors or other inputting devices 510, 515, 520, and 525 which are located in various locations within furnace 100 or in the hot zone and various locations within the cooling zone. The inputs received from devices 510, 515, 520, and 525 are communicated to a controller which can be a programmable logic controller (PLC), processor, computer, and/or other device and can further control one or more curtain actuator 530. Curtain actuator 530 is in electrical communication with actuators 535 and 540 in order to open or close the furnace curtains located at the entrance and exit of cooling zone 140. Controller 500 is also in electrical communication with valve flow control unit 550 which can control the flow of conventional gas, cryogenic fluid, oxidizing gas, and/or inert gas inputs into furnace 100.

As previously mentioned, FIG. 2*f* is similar to the embodiment shown in FIG. 2*c* but further comprises controller 600 which is in electrical communication with thermocouples, sensors or other inputting devices 610, 615, 620, 625, 630, and 635 which are located in various locations within furnace 300 or in the hot zone 330 and various locations within the cooling zone 340 including the convective cooling system 360 (e.g., within the cooling system 360 and one or more plenum boxes 373). The inputs received from devices 610, 615, 620, 625, 630, and 635 are communicated to controller 600 which can be a PLC or other device and can further control one or more curtain actuator 640. Curtain actuator 640 is in electrical communication with actuators 645 and 650 in order to open or close the furnace curtains located at the entrance and exit of cooling zone 340. Controller 600 is also in electrical communication with valve flow control unit 655 which can control the flow of conventional gas, cryogenic fluid, feed gas, oxidizing gas, feed gas and/or inert gas into furnace 100.

Various types of cryogenic fluid sprayers can be used with the method, apparatus and system described herein. Examples of the sprayers or spray bars which can be used to introduce the one or more cryogenic fluids include, but are not limited to, arrays of nozzles attached to straight, looped, or combinations thereof distributing pipes. The sprayers may be comprised of any one or more of the following components: austenitic stainless steel and uninsulated piping, refractory material insulated on stainless steel piping, dry nitrogen gas insulated piping, and/or vacuum jacket insulated piping. In certain embodiments, the length of the sprayers may span the width of the conveyor belt and/or extend a certain length into the cooling zone. In one embodiment, the sprayer is in fluid communication with a cryogenic fluid source which travels through one or more series of piping which can be a straight length or branched and allow for the passage of the cryogenic fluid therethrough. In one particular embodiment, the introduction of the cryogenic fluid into the spray is activated by a valve flow control unit which is in electrical communication with a PLC, computer or other device in response to one or more inputs from the end-user and/or readings from the sensors within or proximal to the furnace. The one or more series of piping can be terminated by a plurality of nozzles which are directed at the work piece or metal part to deliver the cryogenic fluid directly onto the surface of the work piece or part.

Figure 2G:
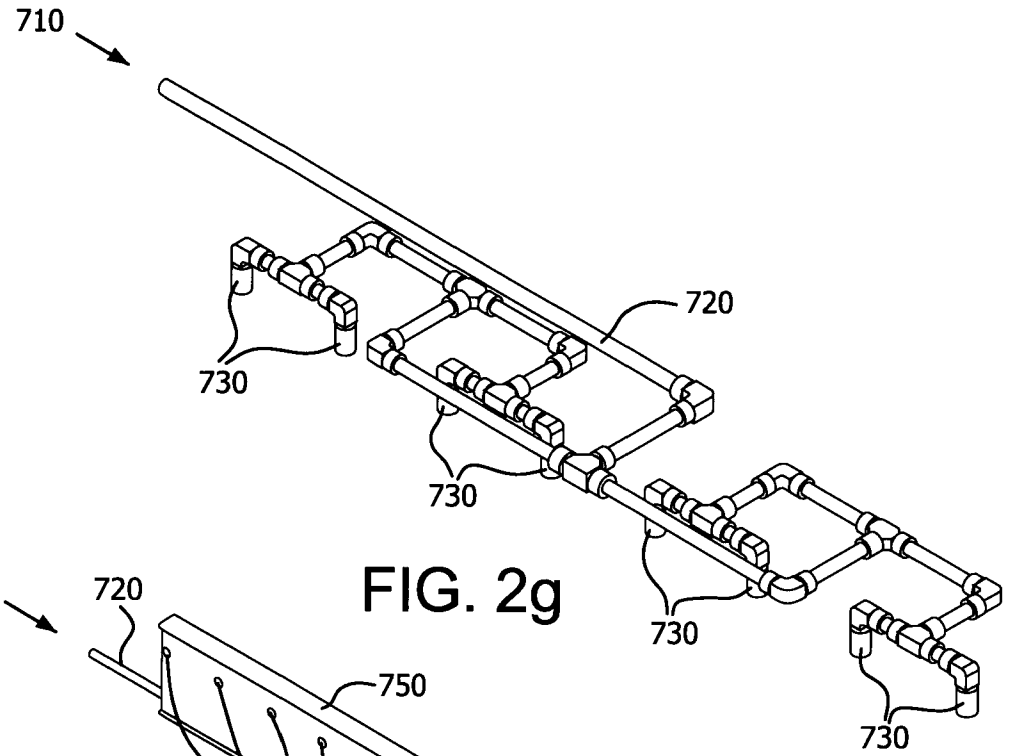
FIGS. 2*g* and 2*h* provides an example of the interior and exterior views of an embodiment of a cryogenic liquid sprayer that may provide for a uniform intensity spray-cooling of one or more work pieces across the width of a conveyor belt within a furnace.
Figure 2H:
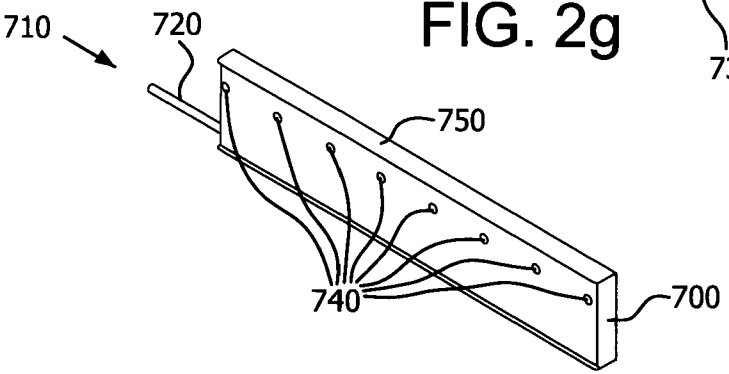

FIGS. 2*g* and 2*h* provides an interior and exterior view, respectively, of an embodiment of sprayer 700 used to inject a cryogenic fluid as described herein. In FIGS. 2*f* and 2*h*, sprayer 700 comprises a cryogenic fluid inlet 710, a series of piping 720 and a plurality of nozzles 730 that are in fluid communication with a cryogenic fluid source (not shown). The embodiment shown in FIG. 2*g* may be particularly useful when cooling parts on the widest furnace belts based on the concept of symmetrical branching of the inlet flow into branch levels I, II, and III of piping 720 with 8 nozzles or 730 terminating the last branch of piping 720 which is in fluid communication with a cryogenic fluid source and can atomize liquid nitrogen into V-shaped cones or flat sheets. Piping 720 and nozzles 730 may be used by itself as shown in FIG. 2*g*, or alternatively encapsulated into a box-shaped vacuum jacket 750 as shown in FIG. 2*h*. Referring to FIG. 2*g*, piping 720 (not shown in FIG. 2*h*) is oriented 90° from its orientation in FIG. 2*g* such that nozzles 730 (not shown in FIG. 2*h*) align with a plurality of apertures 740 in vacuum jacket 750 to allow the cryogenic fluid to pass therethrough and into the furnace atmosphere as shown in FIG. 2*h*. It is anticipated that other arrangements of sprayers can be used with the method, apparatus and system described herein.

In one particular embodiment, method described herein for cooling metal parts can be combined with a sub-zero treatment step. In this embodiment, the cooling zone can be equipped with the direct-jetting, cryogenic fluid spraying bars and nozzles such as 143 shown in FIGS. 2*a* and 243 shown in FIG. 2*b*. To achieve the sub-zero treatment effect, the cryogenic fluid flow rate is increased over the level required for effective sinter hardening of the metal part, and the nozzles, such as, for example, 239 in FIG. 2*b*, are pointed at the parts moving on the belt underneath. Temperature sensors installed in the cooling zone, e.g. sensor 525 shown in FIG. 2*e*, can be used to control the cryogenic fluid jetting flow rate in order to cool the parts to one or more sub-zero temperatures. Since thermal conductivity of sintered steels is higher than the heat transfer coefficient between the cryogenic jet and part interface, the temperature of the part during this sub-zero cooling step is relatively uniform, even though the part is cooled from the top side only. For certain embodiments, the combination of sinter hardening and sub-zero treatment in one processing step and in one furnace, may be industrially attractive due to cost reductions.

The process described herein is discussed within the context of a sinter hardened process. However, it is anticipated that certain elements and aspects of the process described herein can be used for other heat treating processes. Further, the process, system, and apparatus are discussed with regard to a continuous belt furnace, it is understood that other types of furnaces may also be used. For example, furnaces such as a vacuum furnace, a pusher furnace, a walking beam furnace, or a roller hearth furnace, among others known to one skilled in the art, are also suitable for practicing the process, system, or apparatus described herein. It is also anticipated that certain elements of the apparatus described herein, such as the cryogenic fluid injector or the real-time analytical system, may also be retrofitted to these furnaces.

As previously mentioned, it is desirable that the cooling rate of the metal part be controlled, e.g., accelerated, within a temperature range of from about 900° C. to about −100° C., or from about 800° C. to about 100° C., or from about 750° C. to about 200° C. The method and apparatus described herein achieves an improved or accelerated cooling rate of at least 25% or greater, of at least 50% or greater, or at least 100% or greater, or at least 200% or greater compared to the cooling rate of existing technologies such as conventional convective cooling, water jacketing, and the like that do not employ a cryogenic fluid. It is believed that injecting one or more cryogenic fluids to the cooling zone of a furnace such that the temperature of the metal part is reduced from about 900° C. to about −100° C. or from about 800° C. to about 100° C., many advantages may be achieved. For example, the use of one or more cryogenic fluids in the cooling atmosphere allows accelerated cooling of the metal parts, and may result in improved material properties or characteristics due to changes in the microstructure of the processed parts. In the case of sinter hardening, accelerated cooling with cryogenic fluids in the cooling zone may result in metal parts that are either harder and/or tougher than those typically produced from conventional cooling. Furthermore, by providing more efficient cooling through by increasing the cooling rate within the cooling zone, the recirculating blower in the convection cooler can be operated at a reduced speed or eliminated, resulting in cost reduction as well as a more stable cooling atmosphere. It is believed that a more stable or reproducible atmosphere during sinter hardening may help achieve favorable characteristics in the processed parts.

As previously mentioned, the method, system or apparatus described herein may allow a reduced amount of alloy powder additives to be used, which also leads to more compressible or denser metal parts. With improved part properties, not only can a less expensive powder mix be used for meeting existing part requirements, but sintered parts can also be used in more demanding applications than otherwise possible. In situations where cooling of the metal parts is a limiting factor in the production throughput, a more rapid cooling (thus, shorter cooling time) will also lead to an increased production rate. In addition, accelerated cooling may also allow a furnace with a shorter cooling zone to be used, and thus, provide a reduction in floor space requirement.

EXAMPLES

Example 1

Computer Simulation of Method Described Herein

Computer simulations of a cryogenic nitrogen injection into a convective cooling system have been performed using Fluent CFD code for an exemplary furnace. The furnace used for the simulation included a water panel which surrounds a convective cooling system and extends through the cooling zone towards the exit point of the furnace wherein the metal parts are conveyed therethrough and 4 plenum boxes which are used to introduce the gas atmosphere through $N_2$ pipes shown in a manner similar to the system illustrated in FIG. 2*c*. Further, in the simulation, a vent was placed over the cooling unit recirculating gas path similar to the gas path shown as 365-370-375 in FIG. 2*c*. The width of the conveyer belt used in the simulations, 38 inches, characterizes a large sintering and sinter hardening furnace. The simulation involves the injection of 5 pounds per minute (lb/min) of cryogenic liquid nitrogen (LIN) into each of the last two of the four plenum boxes within the convective cooling system in the simulation.

Figure 3:
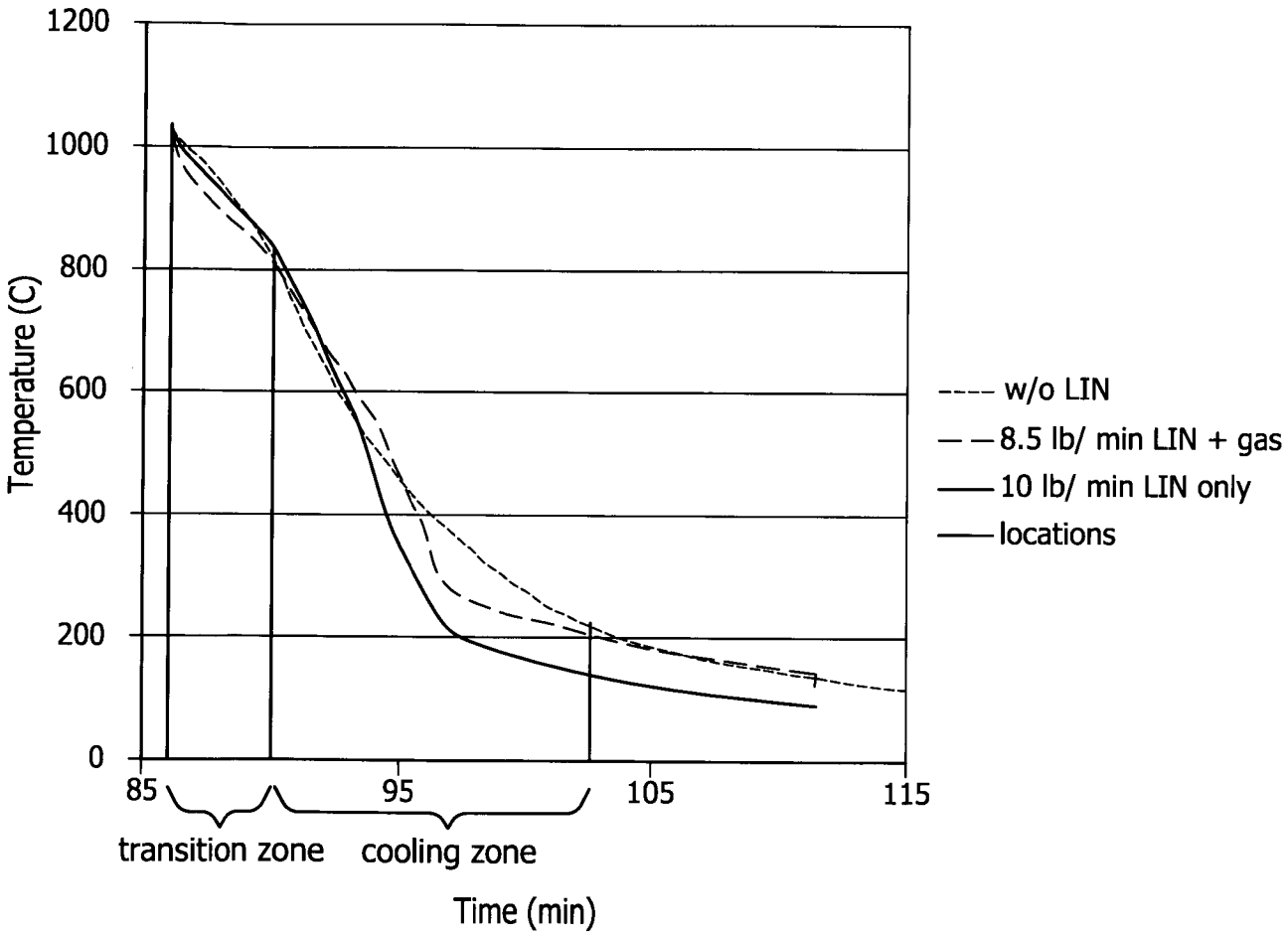
FIG. 3 compares the cooling rate with and without cryogenic fluid injection (e.g., liquefied nitrogen (LIN)) of a computer simulated convective cooling system described in Example 1 as a function of temperature over travel distance (e.g., time traveled through the furnace).
Figure 4:
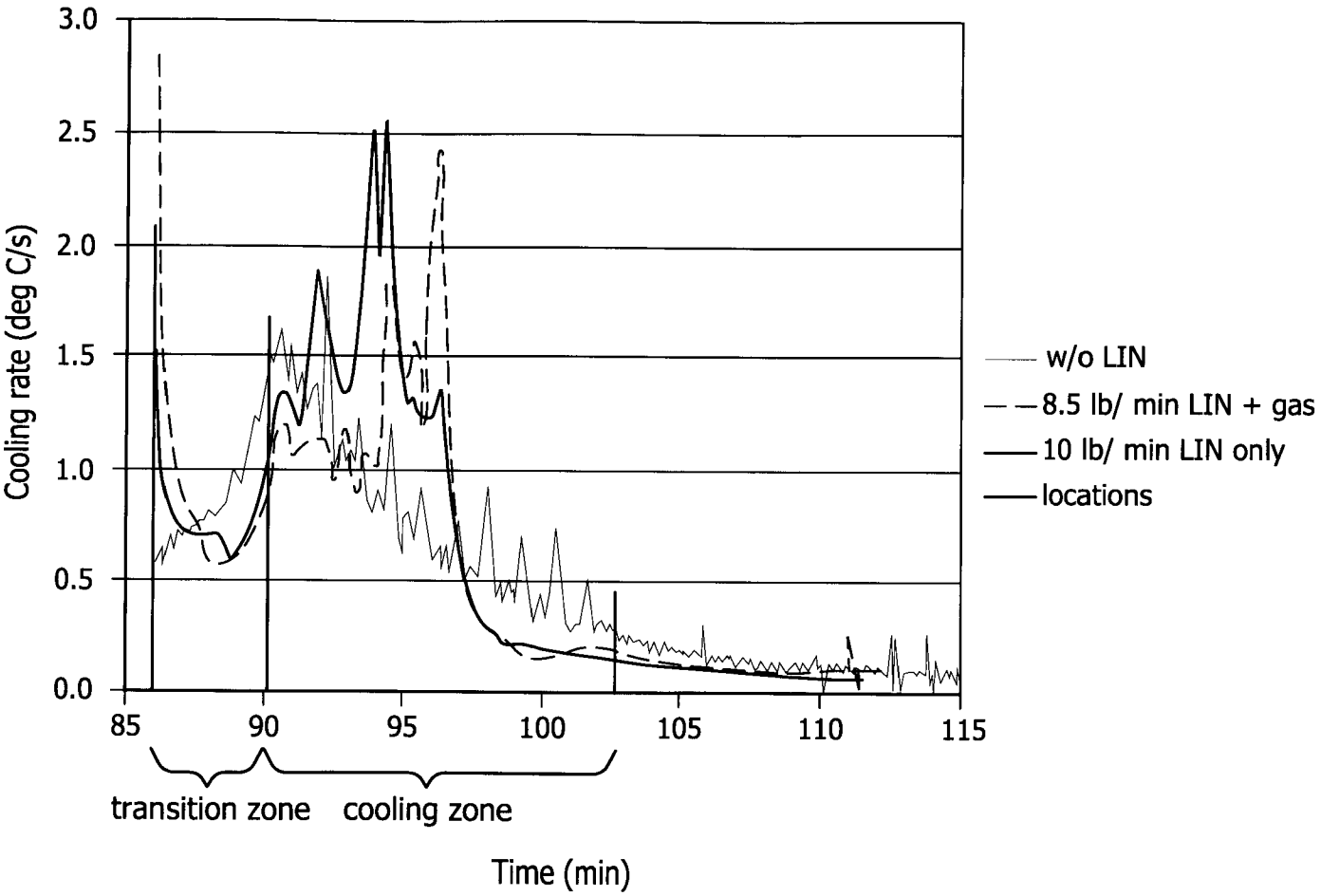
FIG. 4 compares the cooling rate with and without cryogenic fluid or LIN injection of a computer simulated convective cooling system described in Example 1 as a function of cooling rate over travel distance (e.g., time traveled through the furnace).

FIG. 3 provides the metal cooling rate calculated from the temperature profile of the metal load traveling along the cooling section from the hot zone, through the cooling zone, and toward the furnace exit. For both FIGS. 3 and 4, the locations identified on the x-axis (time) designate the transition zone or area between the hot zone and the entrance of the convective cooling system in the cooling zone. FIG. 4 compares the cooling rate with and without LIN as a function of cooling rate measured by ° C./second over time (minutes). The temperature of the metal load entering the cooling zone is approximately 815° C., and the metal mass flow used in the calculation is 1000 lbs/hour using the belt speed of 8 inches/minute. The computer simulation establishes that the injection of LIN may improve the cooling rate under the last two plenum boxes.

Example 2

Small Sintering Furnace

Injection of cryogenic liquid nitrogen experiments were run in a smaller belt furnace, 8.5-inch belt width, designed for the sintering and slows cooling operations rather than convective cooling used in the conventional sinter-hardening operations. The purpose of the experiments was to evaluate the effect of directly injected LIN on the temperature profile of parts traveling through the furnace and, also, to assess the undesired effect of chilling the hot furnace zones if the injected LIN was directed toward furnace entrance rather than furnace exit. The furnace atmosphere comprised pure nitrogen flown at 430 standard cubic feet per house (scfh) into the furnace "shock zone", i.e. the point located immediately after the end of the last hot zone. The conveyor belt was run at a spec of 1.3"/minute. This way of injecting atmosphere gases is very popular in the metal sintering industry. A small quantity of LIN, delivered at 1.8 lbs/minute or 1500 scfh equivalent, was also injected into the shock zone. The furnace exit was terminated with a dense, brush-type curtain used from time to time in the conventional sintering operations, and the furnace entrance was opened in order to direct the flow injected fluids from the shock zone, through the hot zones, to the furnace entrance.

Figure 5:
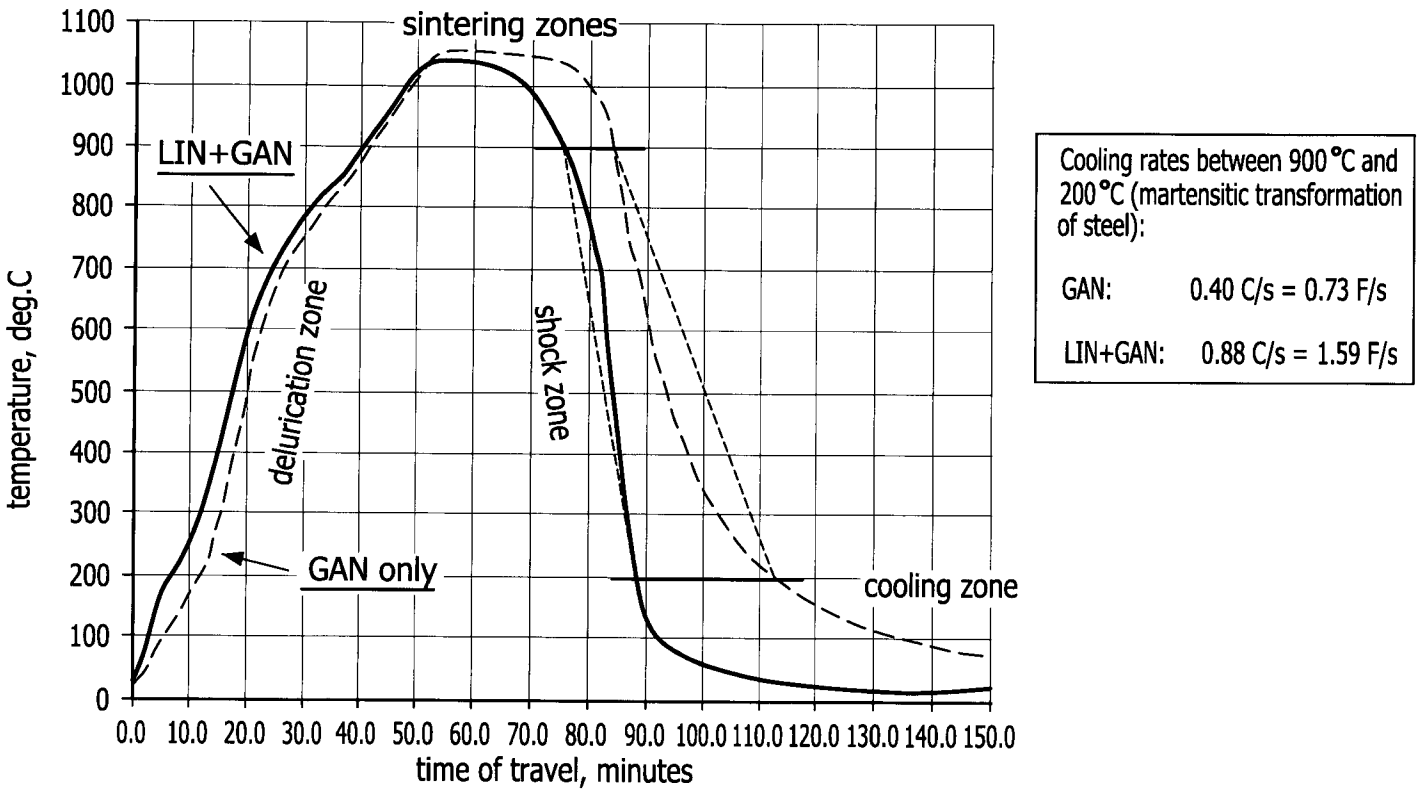
FIG. 5 illustrates the effect of the effect of LIN injection on temperature profile and the cooling rate of steel as described in Example 2.

FIG. 5 illustrates the temperature profiles of parts placed on the belt and traveling through the furnace for the conventional gas only (GAN), and for the method described herein, conventional gas plus LIN (LIN+GAN), testing conditions. It is evident that the method described herein increased the part cooling rate in the shock and cooling zones from 0.40 degrees C./second to 0.88 degrees C./second. This shows an approximately 120% improvement in the cooling rate or an accelerated cooling rate of 120% for the method described herein (e.g., LIN and GAN) over the use of GAN alone.

An undesired effect of chilling the hot zone was manifested by reducing the temperature of the part emerging from the hot zones into the shock zone. This effect may be eliminated by removing the dense curtain from the furnace exit and, thus, redirecting the flow of evaporated LIN to the cooling zone and to the furnace exit. The last observation made during the described testing concerned the temperature of the part at the end of the cooling zone, near the furnace exit. This temperature readily dropped to nearly 0° C., i.e. much below the ambient temperature of about 20° C. The practical significance of this temperature drop for the sinter-hardenable and the other, transformation-hardenable alloy steel parts may be recognized by analyzing the start (Ms) and end (Mf) temperatures of martensitic transformation. For the most popular steel grades, the value of Ms ranges from about 350° C. to about 200° C., but the value of Mf may range from about 100° C. down to subzero temperatures. Thus, the method, apparatus and system described herein, in contrast to the conventional, water heat exchanger cooled, gas convective methods and systems, enables achieving a more complete martensitic transformation which improves a number of part properties and may eliminate additional processing operations conventionally following the continuous furnace treatment.

Figure 6:
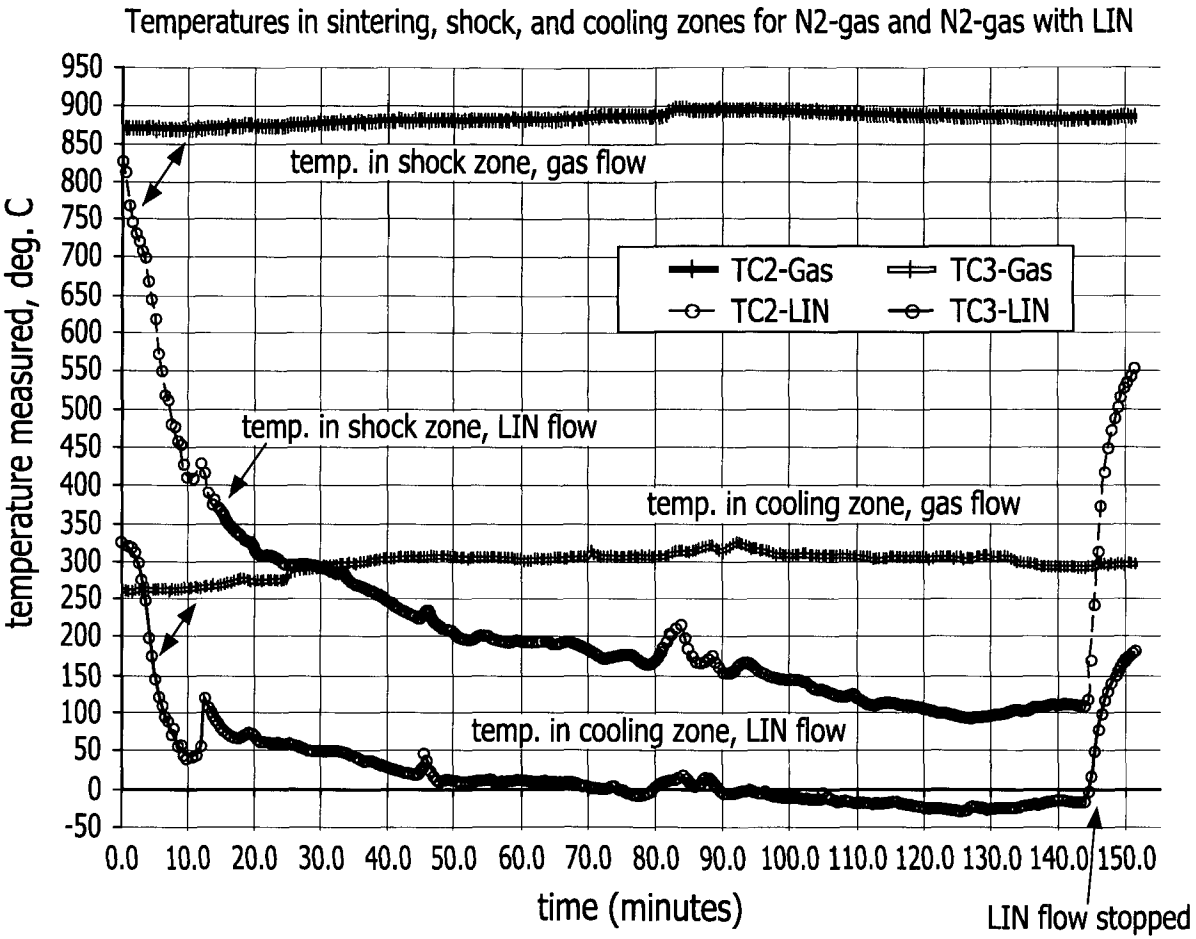
FIG. 6 provides the temperatures for sintering, shock, and cooling zones for nitrogen ($N_2$) gas atmosphere (GAN) and $N_2$ gas atmosphere (GAN) including liquefied nitrogen (LIN) as described in Example 2.

FIG. 6 depicts the evolution of temperature with time at fixed locations within the furnace at a process time ranging from 0 to 150 minutes (which is the total time of experiment). The fixed locations selected included shock zone, where fresh sintering gas blend is, conventionally, introduced into sintering furnace and a cooling zone, extending from the shock zone to the furnace exit and surrounded by a conventional, water cooled jacket. The temperature in the shock zone, just above belt surface was measured with thermocouple TC2, and the temperature in the middle of the cooling zone was measured with thermocouple TC3. Before time 0, the furnace was filled with a conventional sintering gas or nitrogen gas atmosphere using the same conditions as specified above. Next, furnace temperature profile was monitored over a period of 150 minutes for the conventional, nitrogen gas atmosphere as shown by the temperature curves TC2-Gas and TC3-Gas. In the subsequent test, liquid nitrogen (LIN) was injected into the shock zone together with the conventional sintering or nitrogen gas in the same manner as shown in FIG. 2*a* and indicated by the injection points 143. The flow of LIN was opened at time zero and stopped at 145 minutes. The LIN flow rate used was the same as specified above. Both the TC2-LIN and TC3-LIN curves, corresponding to the TC2-Gas and TC3-Gas curves revealed a rapid and consistent drop in the temperature of shock zone and cooling zone with the introduction of LIN. The LIN flow rate used in this experiment is sufficient to reduce the temperature of the parts in the cooling zone to below the freezing point of water which may be desired in sub-zero treatments. Alternatively, the cooling zone temperature may be increased by injecting less LIN into the shock zone.

Example 3

Production Sinter-Hardening Comparisons

The present example compared standard sintering conditions and two embodiments of the method described herein on a production sinter-hardening furnace. Two powder mix alloy compositions were prepared and designated Metal Alloy 1 and Metal Alloy 2. Metal Alloy 1 has a composition analogous to that of Ancorsteel® 721 SH. Metal Alloy 2 is substantially similar to Metal Alloy 1 except that it contained less molybdenum and nickel than Metal Alloy 1. In all cases, the belt speed, size, shape and density of the metal parts, and sintering temperature profile settings on the furnace, were the same. Cooling condition 1 consisted of the following, "normal" operating conditions: a sintering gas comprising 90/10 by volume, a high sintering temperature of 2150° F., and a Varicool convective cooling blower set to a frequency of 50 Hertz (Hz) which is near its maximum cooling output. Cooling condition 2 included liquid nitrogen directly sprayed onto the metal parts within the Varicool unit, in addition to the normal operating conditions defined in cooling condition 1 (including the 50 Hz Varicool convective cooling). Because of the liquid nitrogen/cool nitrogen gas added, the furnace atmosphere contained approximately 4-5% by volume hydrogen. Cooling condition 3 consisted of liquid nitrogen directly sprayed onto the metal parts within the Varicool unit, along with the addition to nitrogen/hydrogen gas input, except that the convective cooling unit was turned down to 6 Hz which is near the minimum Varicool output. Hydrogen level of cooling condition 3 was approximately 4-5% by volume.

The apparent hardness of the Metal Alloy 1 and Metal Alloy 2 parts were measured using Scale C on a Rockwell Hardness Tester (HRC) and the results are provided in Table I. The method used is as described in ASTM E18-08b (Standard Test Methods for Rockwell Hardness of Metallic Materials). Under normal sinter-hardening furnace operating conditions, the apparent hardness of Metal Alloy 2 was less than that of Metal Alloy 1. However, using cooling conditions 2 and 3, or two embodiments of the method described herein, the apparent hardness of the experimental lean alloy parts had HRC measurements of 39 and 43, respectively, which are comparable and slightly improved over the apparent hardness of Metal Alloy A in cooling condition 1.

TABLE I

Apparent Hardness (HRC) of Sinter-hardened PM Parts

| Powder Mix | Cooling condition 1 Normal Varicool sinter-hardening | Cooling condition 2 Normal Varicool + LIN sinter-hardening | Cooling condition 3 LIN + Minimal Varicool sinter-hardening |
|---|---|---|---|
| Metal Alloy A | 38 | 42 | — |
| Metal Alloy B | 25 | 39 | 43 |

The invention claimed is:

1. A method for processing a metal part in a continuous furnace, the method comprising:

providing the furnace wherein the metal part is passed therethrough on a conveyor belt and comprises a hot zone and a cooling zone wherein the cooling zone has a first temperature;

circulating a feed gas through the cooling zone using a convective cooling system;

introducing a cryogenic fluid at a pressure from 15 to 500 psig into the cooling zone where the cryogenic fluid reduces the temperature of the cooling zone to a second temperature, wherein at least a portion of the cryogenic fluid provides a vapor within the cooling zone and cools the metal parts passing therethrough, wherein the cryogenic fluid is introduced into the cooling zone by spraying directly onto the metal part; and providing one or more temperature sensors located within the furnace, wherein the furnace further comprises one or more curtains having an actuator to open and close the one or more curtains and wherein at least one of the temperature sensors is in electrical communication with the actuator and a programmable logic controller (PLC); and wherein the PLC controls the temperature of the metal part by directing the actuator to open or close one or more of the curtains based upon information obtained by the PLC from the one or more temperature sensors.

2. The method of claim 1 further comprising: directing at least a portion of the vapor toward the exit end of the furnace.

3. The method of claim 1 further comprising: venting at least a portion of the vapor before entering the hot zone.

4. The method of claim 3 wherein the furnace further comprises a plurality of gas composition sensors located within the hot zone and the cooling zone wherein the composition sensors are in electrical communication with a valve control unit to control the composition of an atmosphere of the furnace to a predetermined level.

5. The method of claim 1, wherein a portion of a floor of the furnace in the cooling zone comprises a jacket comprising water and wherein a temperature of the water is maintained above the freezing point.

6. The method of claim 1, wherein the cryogenic fluid is spraying onto the metal parts using a spray bar comprising a piping in fluid communication with a cryogenic fluid source and a plurality of nozzles that terminate the ends of the piping which allows the cryogenic fluid to pass therethrough.

7. The method of claim 6 wherein the spray bar further comprises a vacuum jacket comprising a plurality of apertures which align with the apertures of the nozzles to allow the cryogenic fluid to pass therethrough.

8. The method of claim 1, wherein cryogenic fluid is introduced into the cooling zone indirectly through a convective cooling system.

9. The method of claim 1, where the metal parts comprise powder metallurgy parts.

10. The method of claim 1 wherein at least one of the temperature sensors is in electrical communication with one or more valves through a valve control unit to control the introducing of the cryogenic fluid.

11. The method of claim 1, wherein the cryogenic fluid and feed gas cool the metal part at an accelerated rate within a first temperature range, the accelerated rate being at least 25% greater than a cooling rate that would occur in the absence of the cryogenic fluid, the first temperature range being 750 degrees C. to 200 degrees C.

12. The method of claim 1, wherein the first temperature range is 800 degrees C. to 100 degrees C.

13. The method of claim 12, wherein the accelerated rate is at least 100% greater than a cooling rate that would occur in the absence of the cryogenic fluid.

* * * * *